US011091285B2

(12) United States Patent
Jovanovic et al.

(10) Patent No.: US 11,091,285 B2
(45) Date of Patent: Aug. 17, 2021

(54) ADJUSTABLE, INLINE PACKAGING MACHINE FOR FILLING AND SEALING POUCHES AND METHOD OF USING SAME

(71) Applicant: Nortech, Inc., Glendale Heights, IL (US)

(72) Inventors: Bojan Jovanovic, Glendale Heights, IL (US); David Showman, Glendale Heights, IL (US); Sergej Krneta, Glendale Heights, IL (US)

(73) Assignee: NORTECH, INC., Glendale Heights, IL (US)

( * ) Notice: Subject to any disclaimer, the term of this patent is extended or adjusted under 35 U.S.C. 154(b) by 83 days.

(21) Appl. No.: 16/170,950

(22) Filed: Oct. 25, 2018

(65) Prior Publication Data

US 2020/0130878 A1 Apr. 30, 2020

(51) Int. Cl.

| | |
|---|---|
| ***B65B 59/00*** | (2006.01) |
| ***B65B 43/14*** | (2006.01) |
| ***B65B 61/02*** | (2006.01) |
| ***B65B 43/54*** | (2006.01) |
| ***B65B 43/26*** | (2006.01) |
| ***B65B 51/14*** | (2006.01) |

(52) U.S. Cl.

CPC ..... *B65B 59/001* (2019.05); *B65B 43/14* (2013.01); *B65B 43/26* (2013.01); *B65B 43/54* (2013.01); *B65B 51/146* (2013.01); *B65B 61/025* (2013.01)

(58) Field of Classification Search

CPC ..... B65B 59/001; B65B 43/14; B65B 43/26; B65B 43/54; B65B 43/46; B65B 43/465; B65B 43/30; B65B 51/146; B65B 61/025

USPC ..... 53/570, 284.7, 386.1, 469, 468, 571

See application file for complete search history.

(56) References Cited

U.S. PATENT DOCUMENTS

| | | | | |
|---|---|---|---|---|
| 3,566,578 A * | 3/1971 | Thorne et al. | ..... | B65B 41/18 53/525 |
| 3,673,759 A * | 7/1972 | Ayres | ..... | B65B 43/26 53/459 |
| 3,812,649 A * | 5/1974 | Clancy | ..... | B65B 43/465 53/564 |
| 3,955,334 A * | 5/1976 | Wild | ..... | B65B 43/18 53/459 |

(Continued)

*Primary Examiner* — Dariush Seif

(74) *Attorney, Agent, or Firm* — Moore & Van Allen PLLC; Jeffrey R. Gray

(57) ABSTRACT

An inline packaging machine for automatically accommodating and filling different sized containers, such as pouches, to reduce changeover time and thereby improve operating efficiency of the machine. The machine includes stations disposed longitudinally along a center line of the machine, including a first carrier track opposing a second carrier track with respect to the center line. A first clamp is disposed on the first carrier track and at least a second clamp is disposed on the second carrier track wherein the clamps are configured to releasably secure first-sized pouches for filling. The pouches are advanced inline from a setup station through an opening station to a filling station for filling with contents. The filled pouches are then advanced to a sealing and discharging station. A control system automatically adjusts the distance between the corresponding clamps to accommodate second-sized and/or third-sized pouches for inline processing and filling.

24 Claims, 17 Drawing Sheets

(56) References Cited

U.S. PATENT DOCUMENTS 4,108,300 A * 8/1978 Hayase ..... B65B 43/26 198/470.1
4,174,599 A * 11/1979 Callet ..... B65B 43/30 53/512
4,211,053 A * 7/1980 Niccolls ..... B65B 43/18 53/386.1
4,263,768 A * 4/1981 Russell ..... B65B 43/465 198/803.4
4,330,288 A * 5/1982 Russell ..... B65B 43/34 198/377.07
4,432,186 A * 2/1984 McGregor ..... B65B 39/08 141/114
4,510,736 A * 4/1985 Muller ..... B65B 1/02 53/284.7
4,674,266 A * 6/1987 Araki ..... B29C 66/843 156/583.5
4,823,538 A * 4/1989 Takamura ..... B65B 31/06 53/284.7
5,058,364 A * 10/1991 Seiden ..... B65B 43/123 53/455
6,073,424 A * 6/2000 Kraft ..... B65B 43/465 53/570
6,276,117 B1 * 8/2001 Wiles ..... B65B 43/465 53/570
6,701,697 B2 * 3/2004 Savigny ..... B65B 25/04 53/247
6,862,866 B2 * 3/2005 Jacobsen ..... B65B 7/02 53/133.4
7,882,685 B2 * 2/2011 Koga ..... B65B 43/465 53/570
8,122,684 B2 * 2/2012 Kurz ..... B65B 43/465 53/284.7
8,151,543 B2 * 4/2012 Veix ..... B65B 43/465 53/64
8,468,783 B2 * 6/2013 Uebler ..... B65B 43/28 53/457
9,022,719 B2 * 5/2015 Yoshikane ..... B65B 43/18 414/796.4
10,351,281 B2 * 7/2019 Garriga Jimenez .. B65B 43/465
2003/0154692 A1 * 8/2003 Parsons ..... B65B 43/30 53/459
2004/0011008 A1 * 1/2004 Hiramoto ..... B29C 66/81435 53/570
2004/0020170 A1 * 2/2004 LaRocca ..... B65B 43/18 53/459
2005/0229547 A1 * 10/2005 Koke ..... B65B 57/12 53/468
2006/0162291 A1 * 7/2006 Gates ..... B65B 43/18 53/459
2009/0308031 A1 * 12/2009 Koga ..... B65B 43/465 53/570
2010/0037561 A1 * 2/2010 Matheyka ..... B65B 43/465 53/459
2013/0343857 A1 * 12/2013 Yoshikane ..... B65B 43/14 414/798.9
2014/0334909 A1 * 11/2014 Ishikawa ..... B65B 35/18 414/795.4
2015/0217889 A1 * 8/2015 Nakamoto ..... B65B 43/50 198/678.1
2015/0284122 A1 * 10/2015 Murray ..... B65B 43/60 248/99
2015/0328855 A1 * 11/2015 Honda ..... B29C 66/43121 53/403
2017/0217608 A1 * 8/2017 Giro Amigo ..... B65B 65/02
2018/0118393 A1 * 5/2018 Yoshikane ..... B65B 59/005
2018/0257800 A1 * 9/2018 Hulleman ..... B65B 25/04

* cited by examiner

ADJUSTABLE, INLINE PACKAGING MACHINE FOR FILLING AND SEALING POUCHES AND METHOD OF USING SAME

TECHNICAL FIELD

The present invention relates generally to a packaging machine. More specifically to a highly adjustable inline packaging machine for filling and sealing pre-made pouches of varying sizes and configurations, where the rapid changeover between different sized pouches is performed automatically by a control system to reduce changeover time and thereby improve operating efficiency of the machine.

BACKGROUND

There are various types of packaging machines which can fill various types of containers such as pouches, cartons, boxes, bottles, jar, and other types of containers. For example, a conventional packaging machine for filling pouches with content such as, but not limited to, nuts, chips, granola, powders, trail mixes, other food products, medication, and other products utilizes a carousel to advance the pouches to the various stations. These carousel packaging machines are typically large machines with a large footprint in a workspace. While generally effective, most carousels of conventional packaging machines are not adjustable to accommodate different sized containers to be filled or packaged. For those carousels that are adjustable, the configuration and structure of the carousel causes operators to spend excessive time adjusting the carousel to process and handle different sized containers. This means that the packaging machine is off-line and inoperative for a long period of time while the operators spend valuable time adjusting the carousel from being configured to handle a first sized container to handle a second sized container that is larger or smaller than the first sized container. These changeovers are labor intensive and cause the machine to be off-line for an extend period of time, for example 30-40 minutes, which reduces the throughput and operating efficiency of the packaging machine.

Accordingly, there is a need to overcome certain of these limitations and other drawbacks of conventional packaging machines, and to provide new features not heretofor available.

SUMMARY OF THE INVENTION

This disclosure provides a unique inline packaging machine for automatically accommodating and filling different sized containers, such as pouches with contents and then sealing the filled pouches is provided. The inline machine comprises a number of stations for the processing and handling of different sized containers to reduce changeover time and thereby improve operating efficiency of the inline packaging machine. A loading or in-feed station for receiving and then feeding the pouches in a flat closed pouch state is disposed longitudinally along a center line of the machine. A processing system is disposed longitudinally along the center line and disposed adjacent the loading station, wherein the processing system interacts with additional stations of the machine. The processing system includes a first carrier track opposing a second carrier track with respect to the center line. At least a first clamp is disposed on the first carrier track and at least a second clamp is disposed on the second carrier track wherein the first clamp and the second clamp are configured to releasably and securely receive the pouches from the loading station in the flat closed pouch state at a setup station of the processing system. Next, the pouches, in the flat closed pouch state, are advanced inline from the setup station to an opening station of the processing station for opening the pouches into an open pouch state. In the open pouch state, the pouches are advanced inline from the opening station to a filling station for filling the pouches with contents. The filled pouches are then advanced inline from the filling station to a sealing and discharging station of the processing system for sealing the filled pouches and discharging the sealed pouches.

According to another aspect of the invention, the inline packaging machine is configured such that a first carrier track and an opposing second carrier track are adjustably arranged with respect to the center line of the machine. The first carrier track and the second carrier track are laterally adjustable with respect to each other and the center line to accommodate securing a first pouch and a second pouch, the pouches having different dimensions. For example, the first pouch includes a first uppermost width in a flat closed pouch state and the second pouch includes a second uppermost width in the flat closed pouch state that is different from the first uppermost width. In this instance, the first carrier track is laterally adjusted relative to the center line and the second carrier track is laterally adjusted with respect to the center line to allow for changeover and handling of the different sized first and second pouches.

According to yet another aspect of the invention, the inline packaging machine is configured such that a first carrier track and an opposing second carrier track are adjustably arranged with respect to a center line of the machine. One of the first carrier track and the second carrier track is laterally adjustable with respect to the center line (and the other carrier track) to accommodate securing a first pouch and a second pouch, the pouches having different dimensions. For example, the first carrier track remains fixed while the second carrier track is laterally adjusted with respect to the center line and the first carrier track to allow for changeover and handling of the different sized first and second pouches.

According to a further aspect of the invention, a sample sequence of steps which can be performed to operate the inline packaging machine for filling and sealing pouches of varying sizes and configurations is disclosed. The sample sequence entails: loading a first pouch and a second pouch into a first magazine receptacle and a second magazine receptacle, respectively, of a loading station of the inline machine, wherein the first pouch is a different size and configuration than the second pouch; transferring the first pouch inline from the loading station to a setup station of the inline machine; securing the first pouch between corresponding clamps; advancing the first pouch inline from the setup station to an opening station of the inline machine, inline from the opening station to a filling station of the inline machine, and inline from the filling station to a sealing and discharging station; sealing and discharging the first pouch at the sealing and discharging station; using a control system to automatically adjust a distance between the corresponding clamps to accommodate a width of the second pouch; and transferring the second pouch inline from the loading station to the setup station for further processing according to the above steps. The packaging machine can also accommodate and then process a third-sized pouch that is loaded into the loading station.

Additional features, advantages, and embodiments of the present disclosure may be set forth or apparent from consideration of the following attached detailed description and drawings. Moreover, it is to be understood that both the foregoing summary of the present disclosure and the following detailed description of figures are exemplary and intended to provide further explanation without limiting the scope of the present disclosure as claimed.

BRIEF DESCRIPTION OF THE DRAWINGS

To understand the present invention, it will now be described by way of example, with reference to the accompanying drawings in which.

Figure 1:
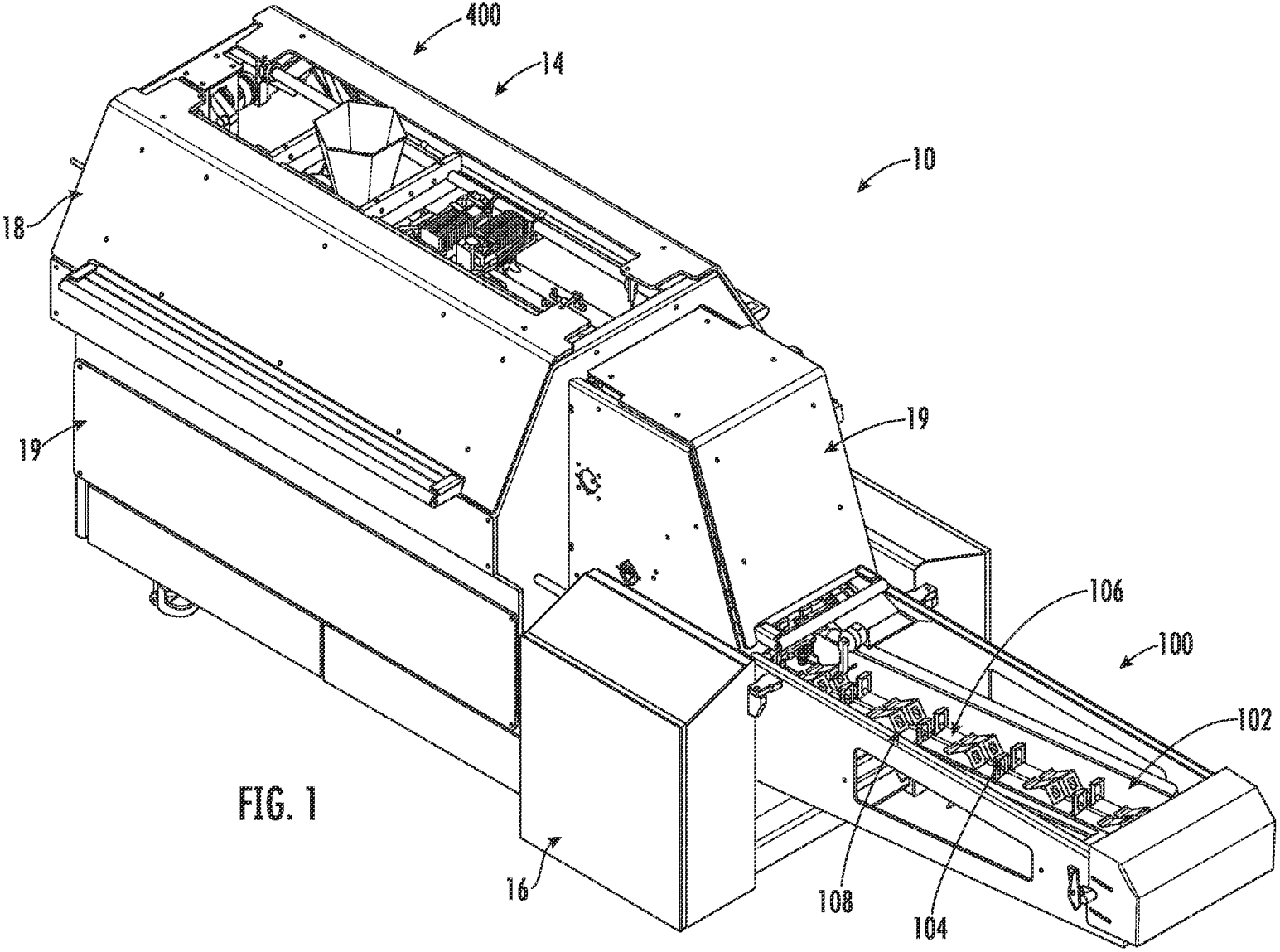
FIG. 1 is a perspective view of an inline packaging machine for filling and sealing pouches of various sizes.
Figure 2:
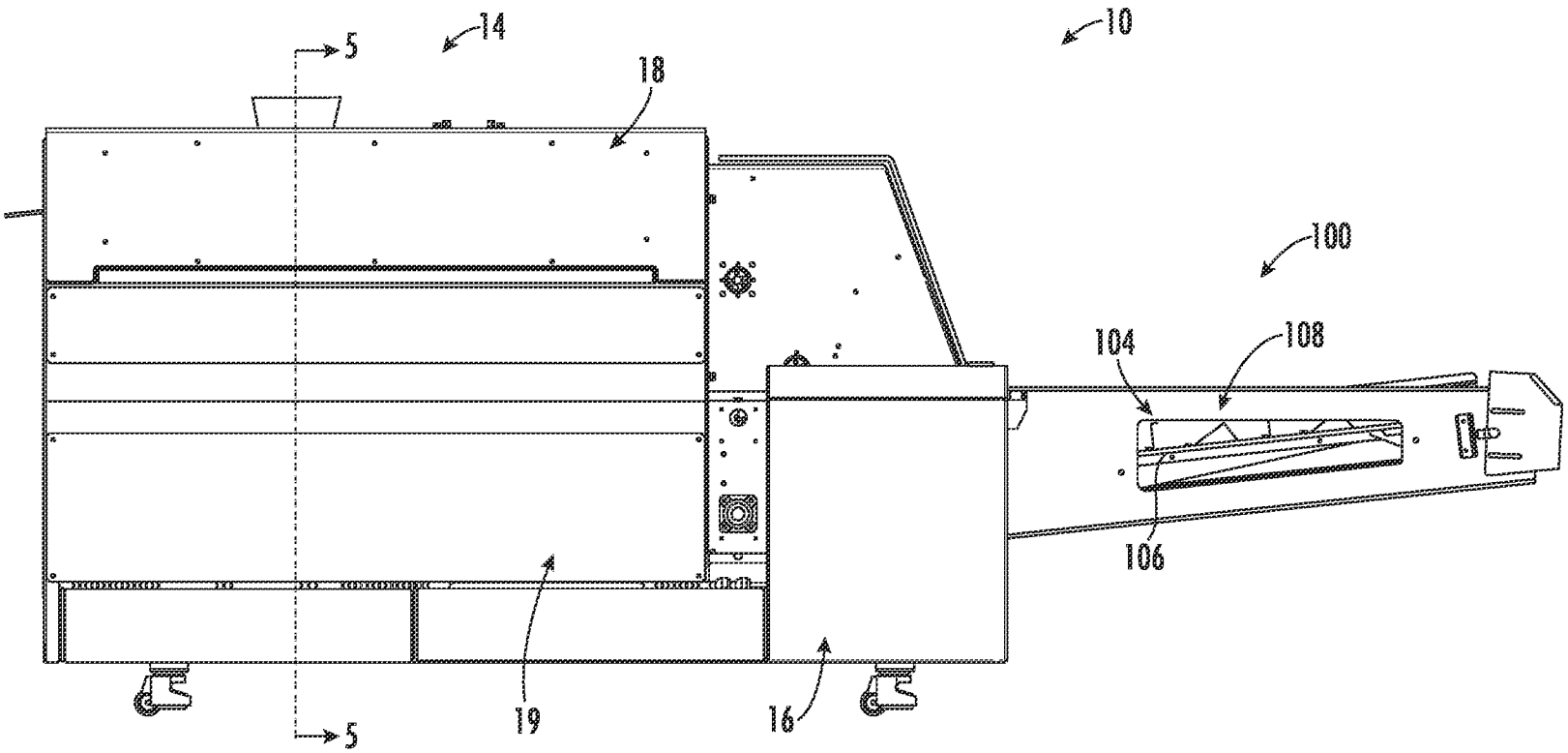
FIG. 2 is a left view of an inline packaging machine of FIG. 1.
Figure 3:
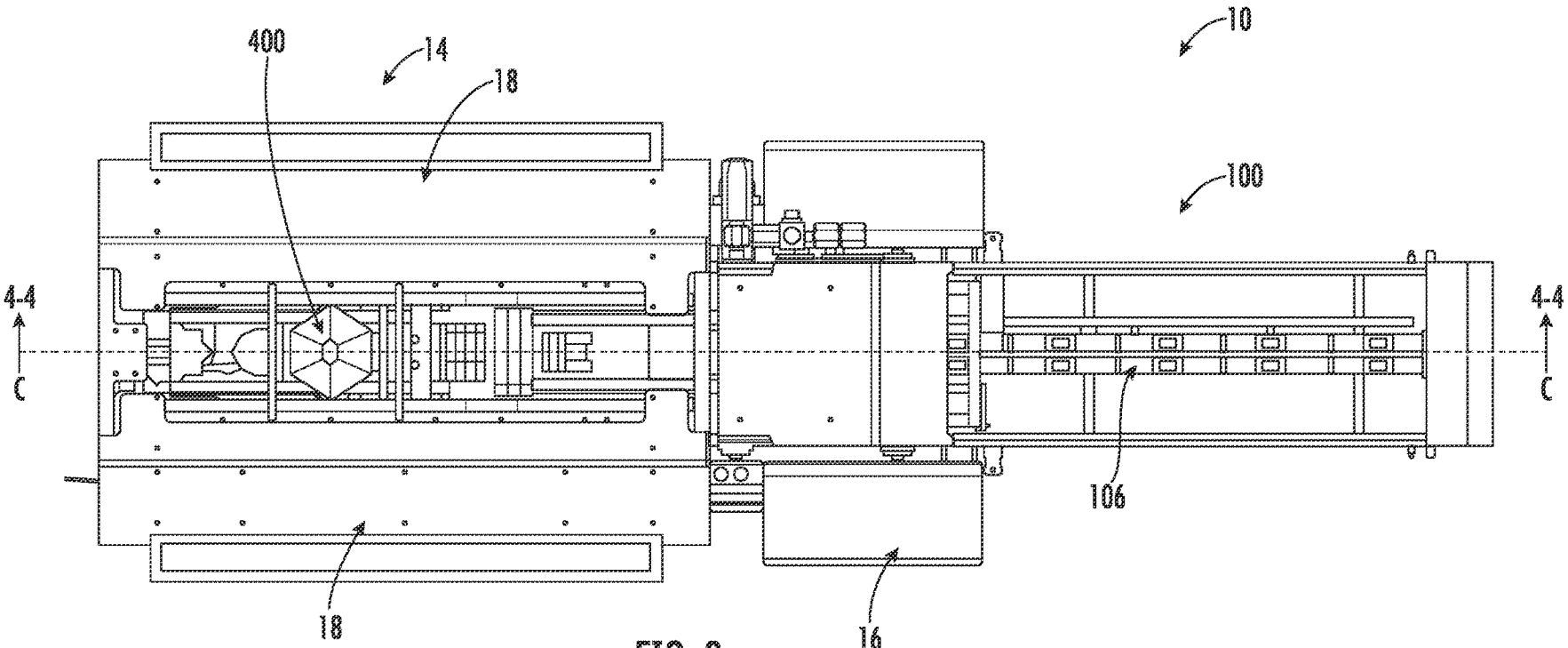
FIG. 3 is a top view of an inline packaging machine of FIG. 1
Figure 4:
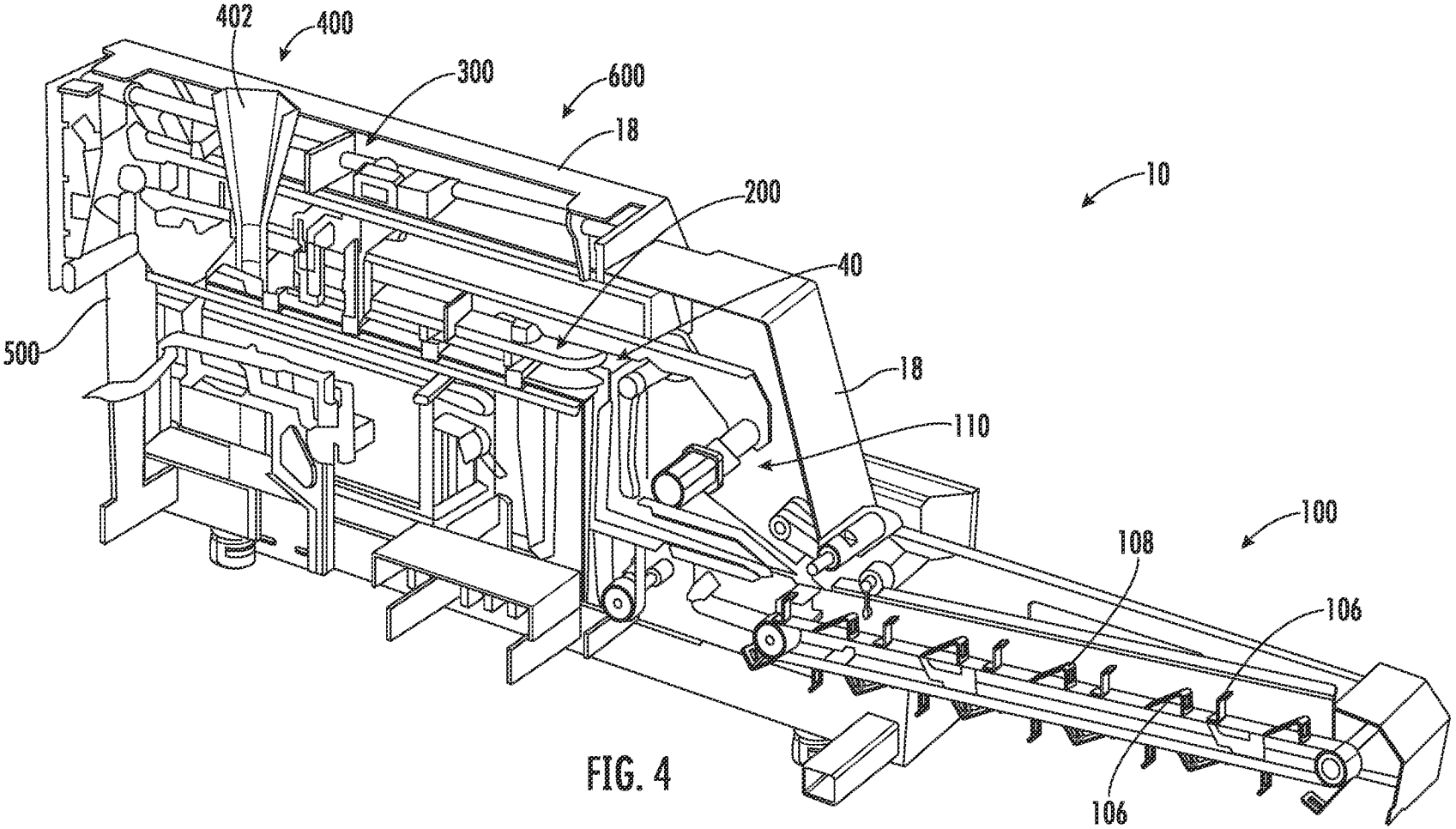
FIG. 4 is a cross-sectional view with perspective treatment of an inline packaging machine of FIG. 1 taken along the 4-4 line shown in FIG. 3.
Figure 5:
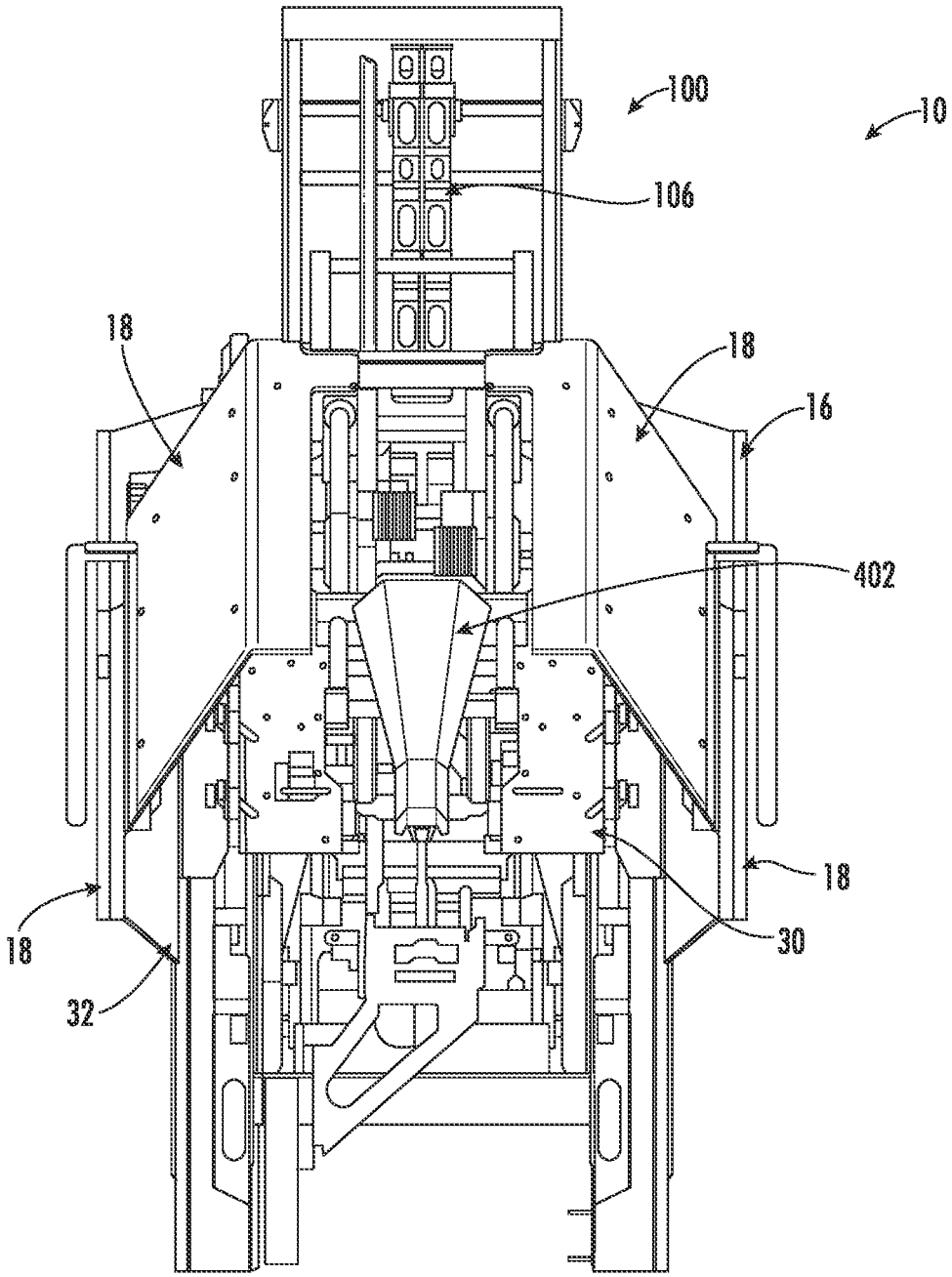
FIG. 5 is a cross-sectional view with perspective treatment of an inline packaging machine of FIG. 1 taken along the 5-5 line shown in FIG. 2.
Figure 6:
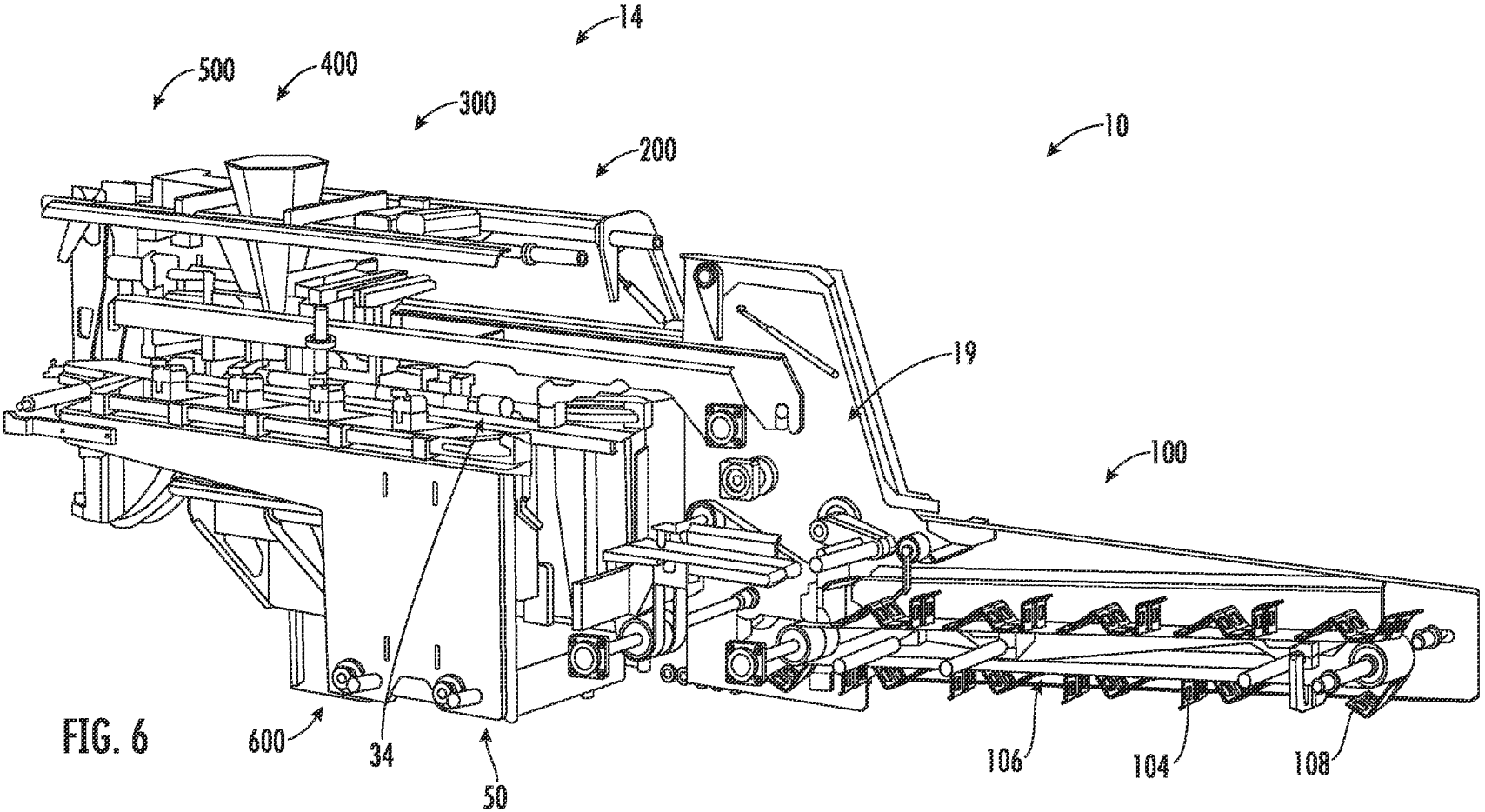
FIG. 6 is a perspective view of the inline packaging machine of FIG. 1 with external panels and frames removed to show internal components of the machine.
Figure 7:
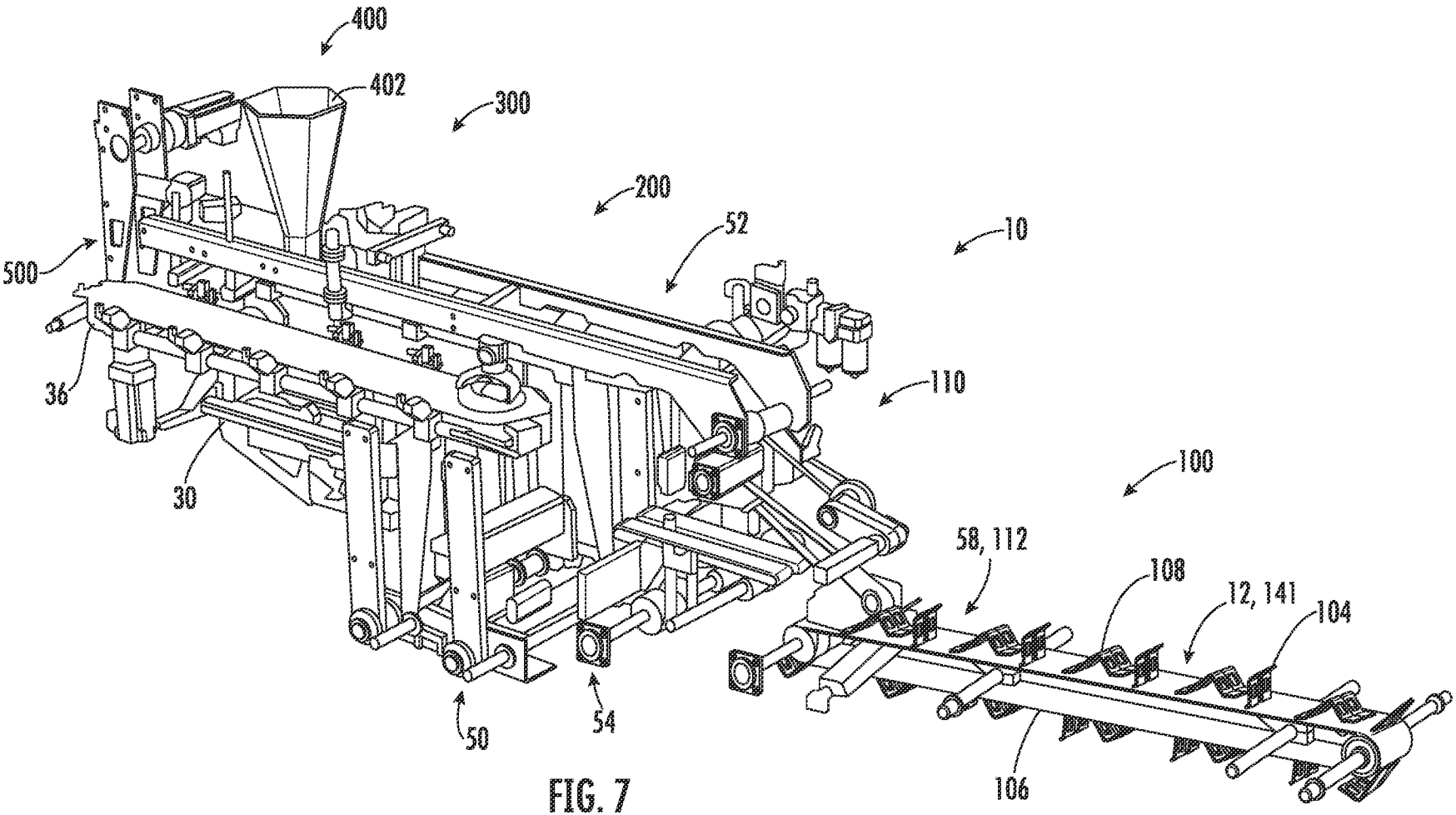
FIG. 7 is a perspective view of the inline packaging machine of FIG. 6 with additional components removed to show further details of the machine.
Figure 8:
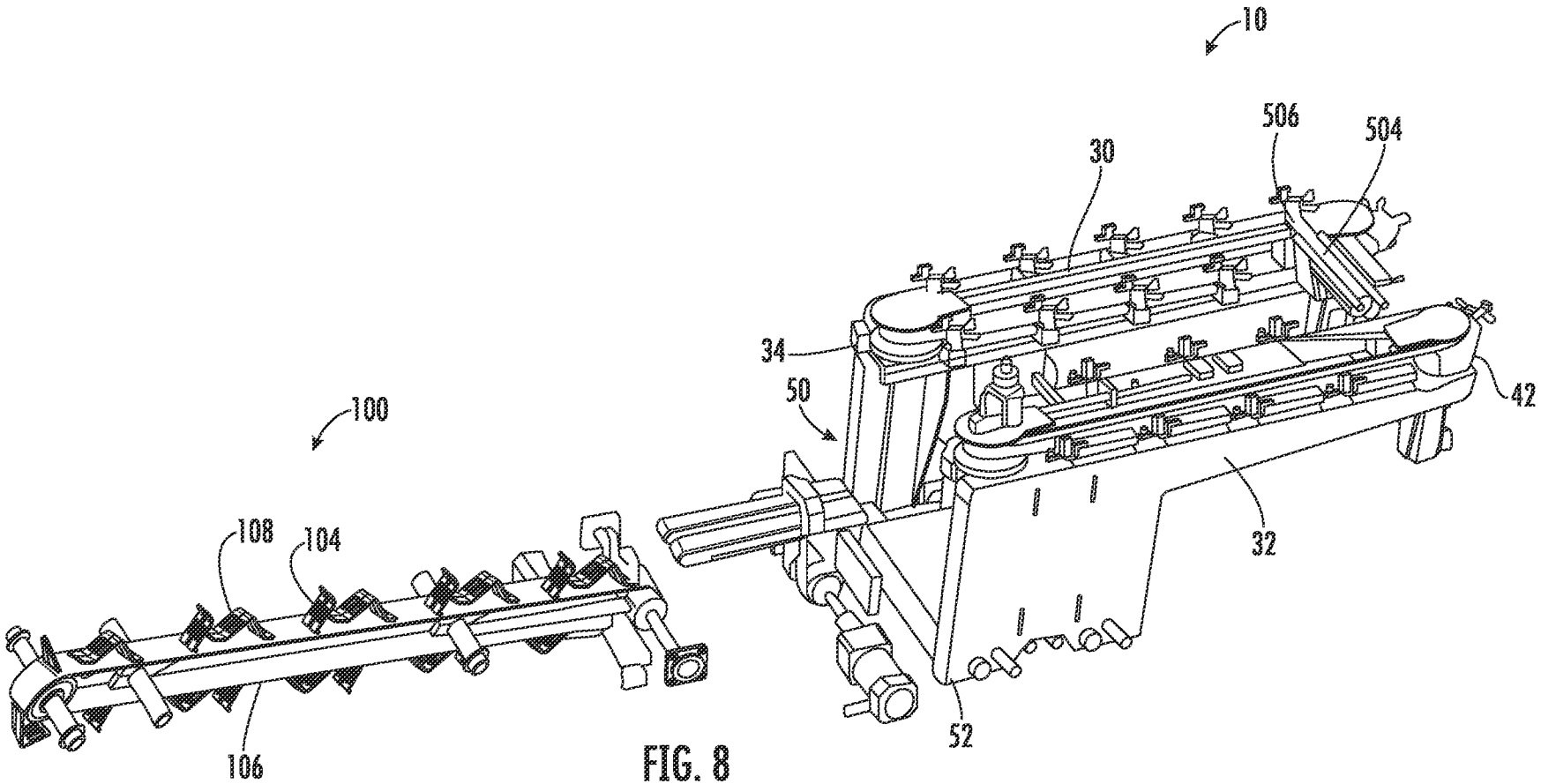
FIG. 8 is a perspective view of the inline packaging machine of FIG. 7 with additional components removed to show further details of the machine.
Figure 9:
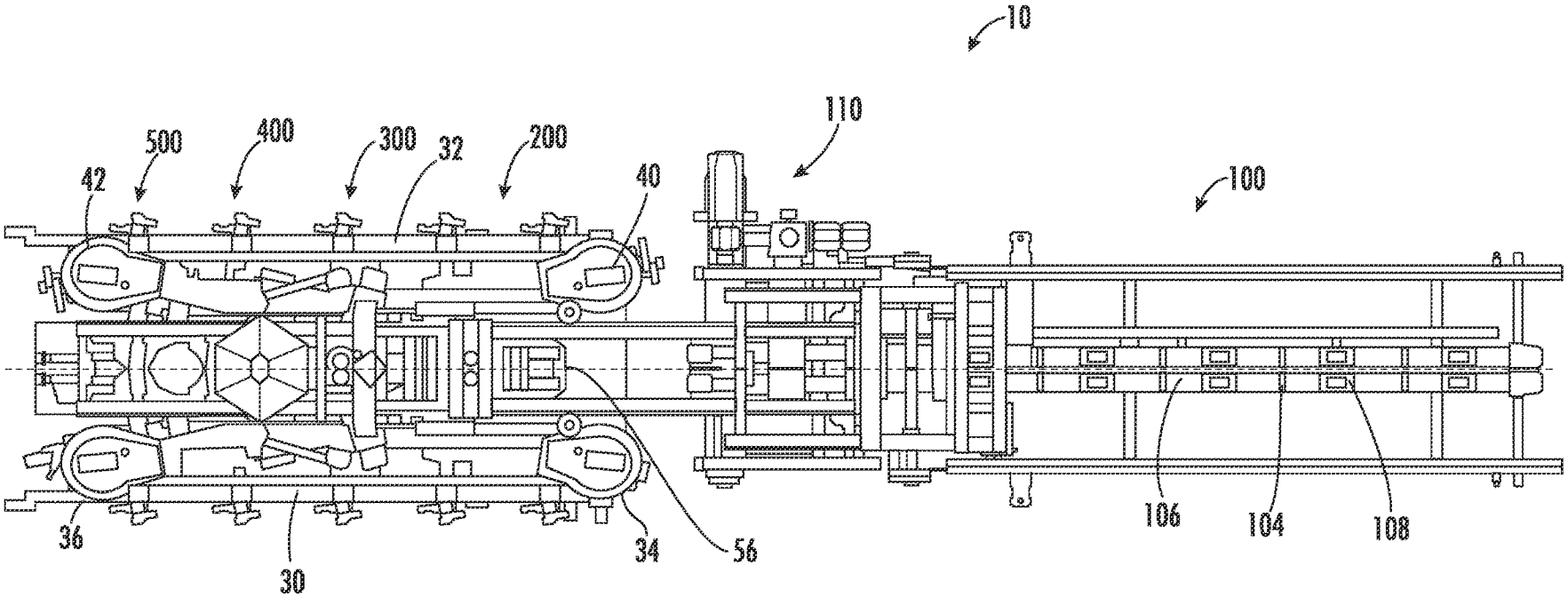
FIG. 9 is a top view of the inline packaging machine of FIG. 7 with additional components removed to show further details of the machine.
Figure 10:
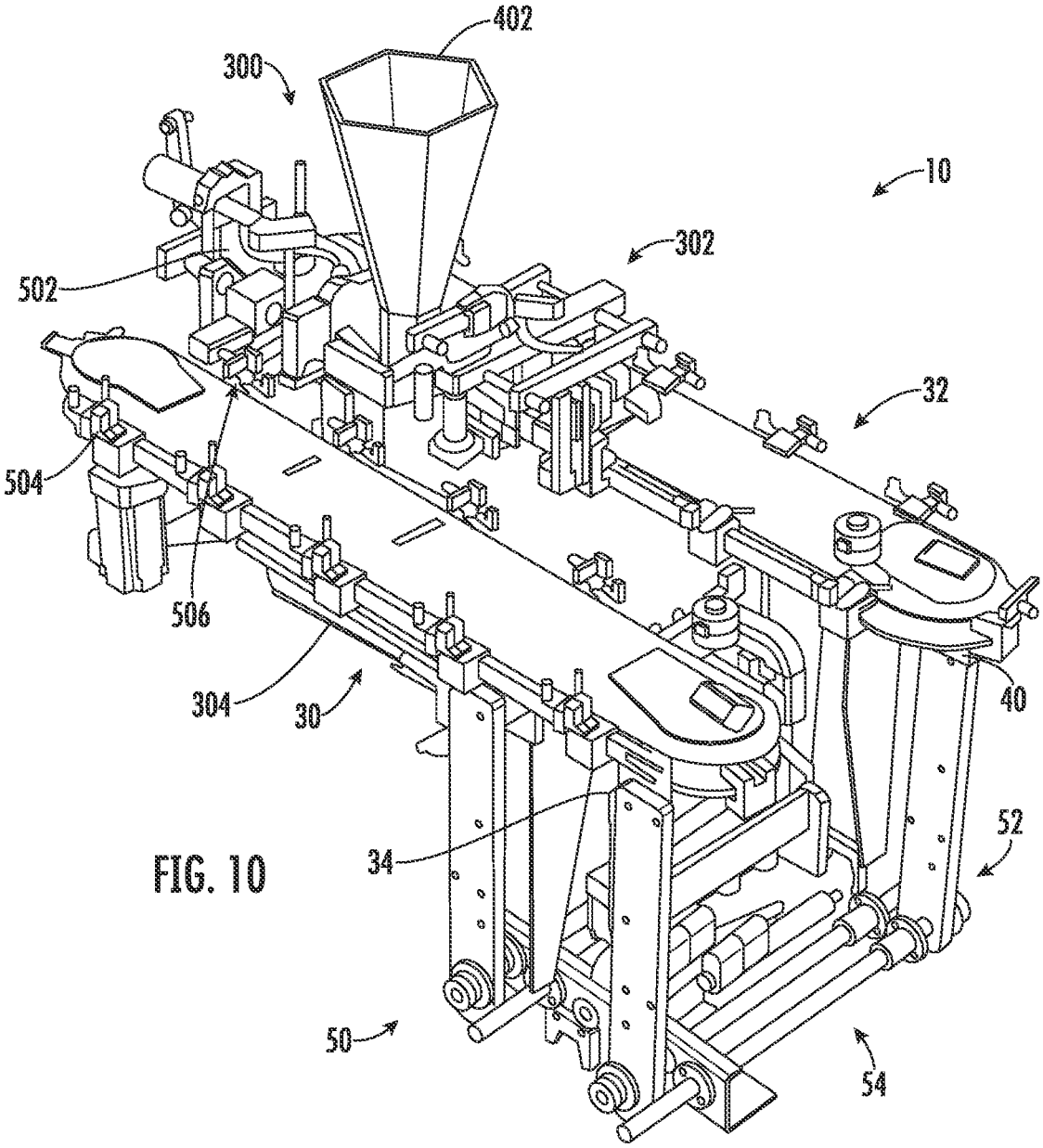
FIG. 10 is side perspective view of the inline packaging machine illustrating a vacuum suction cup mechanism of an opening station, a filler assembly of a filling station, and a hot bar sealer of a sealing and discharge station.
Figure 11:
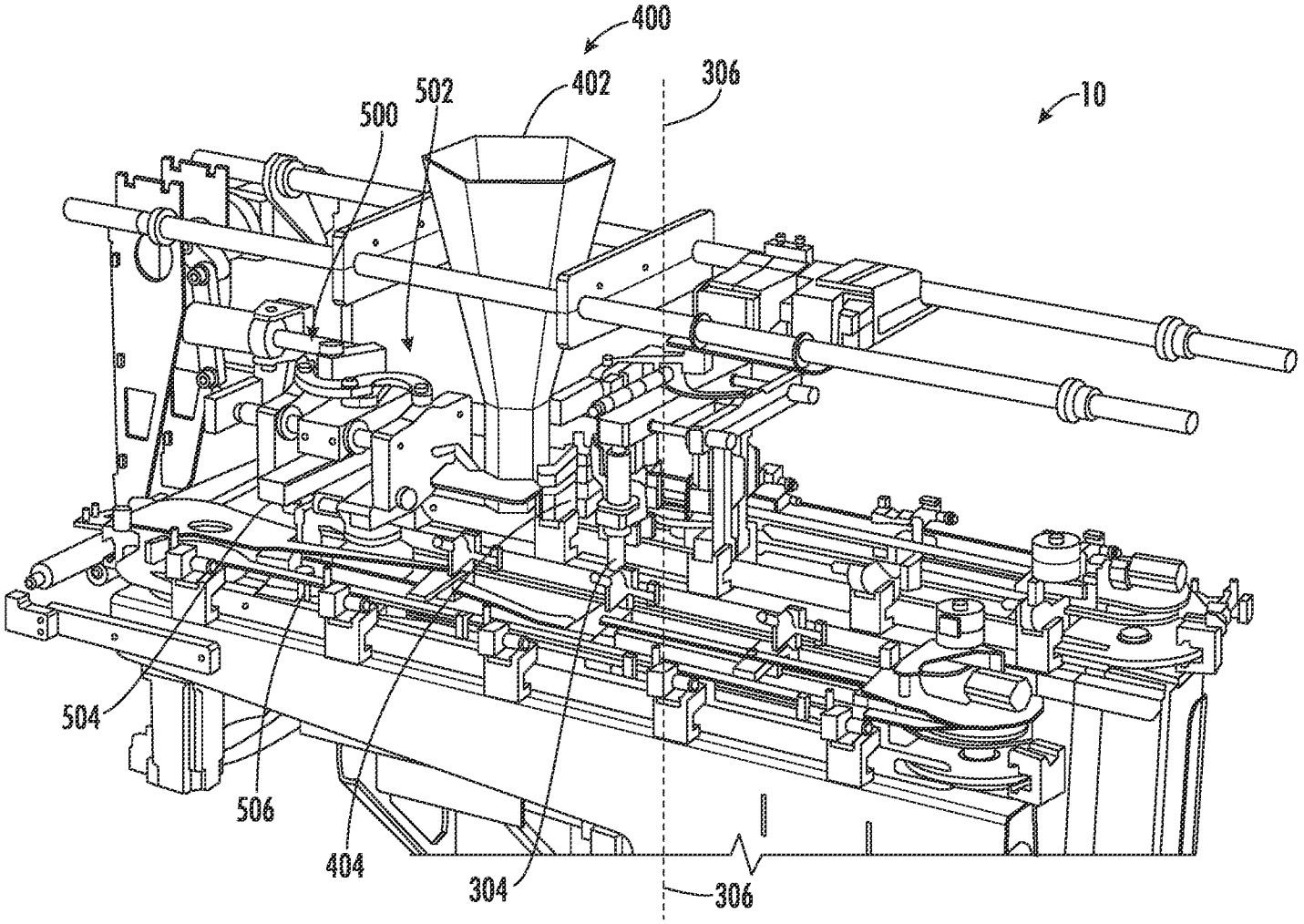
FIG. 11 is a perspective view of the inline packaging machine of FIG. 10 with additional components removed to show further details of the machine.
Figure 12:
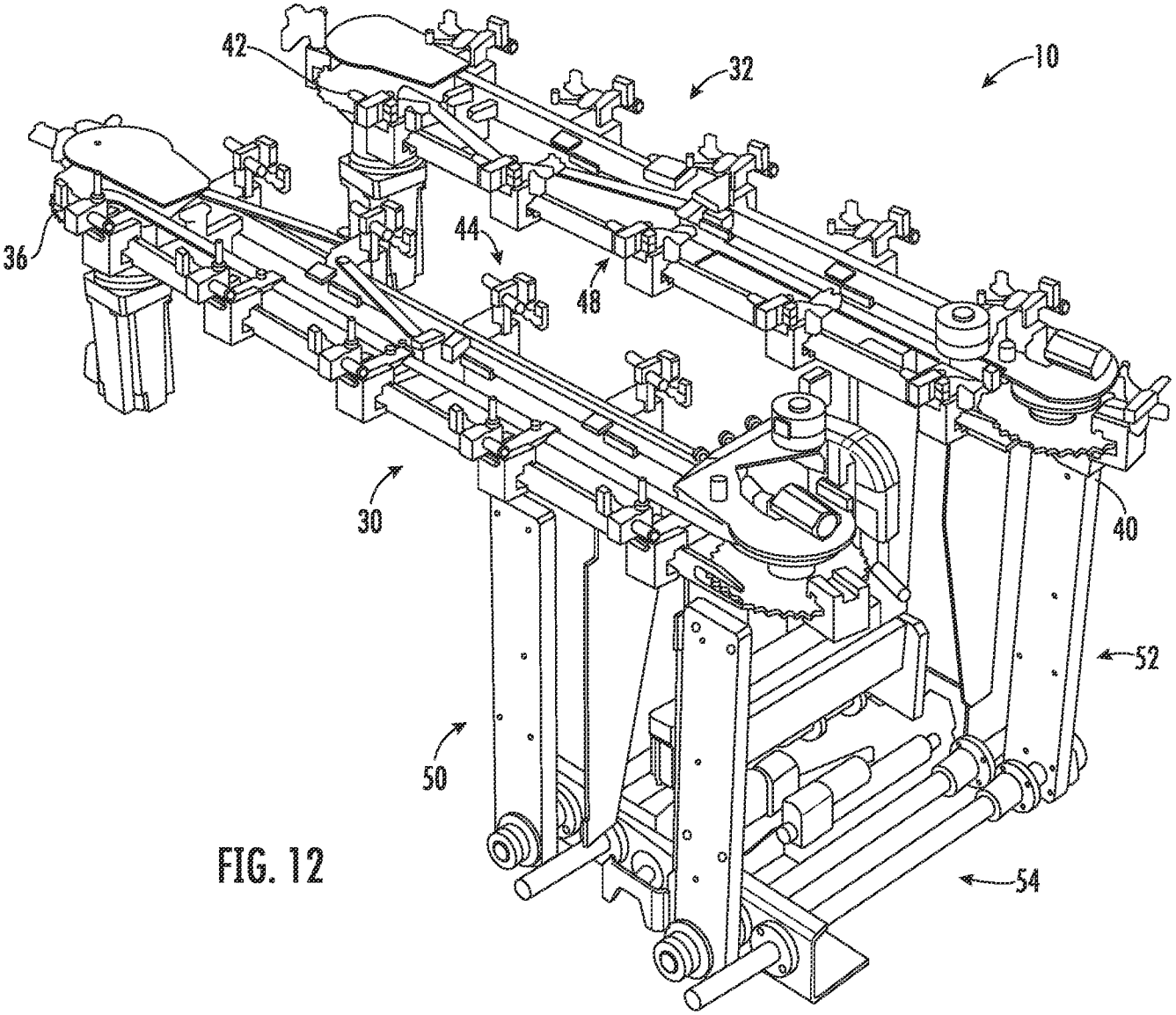
FIG. 12 is a perspective view of the inline packaging machine of FIG. 10 with additional components removed to show further details of the machine.
Figure 13:
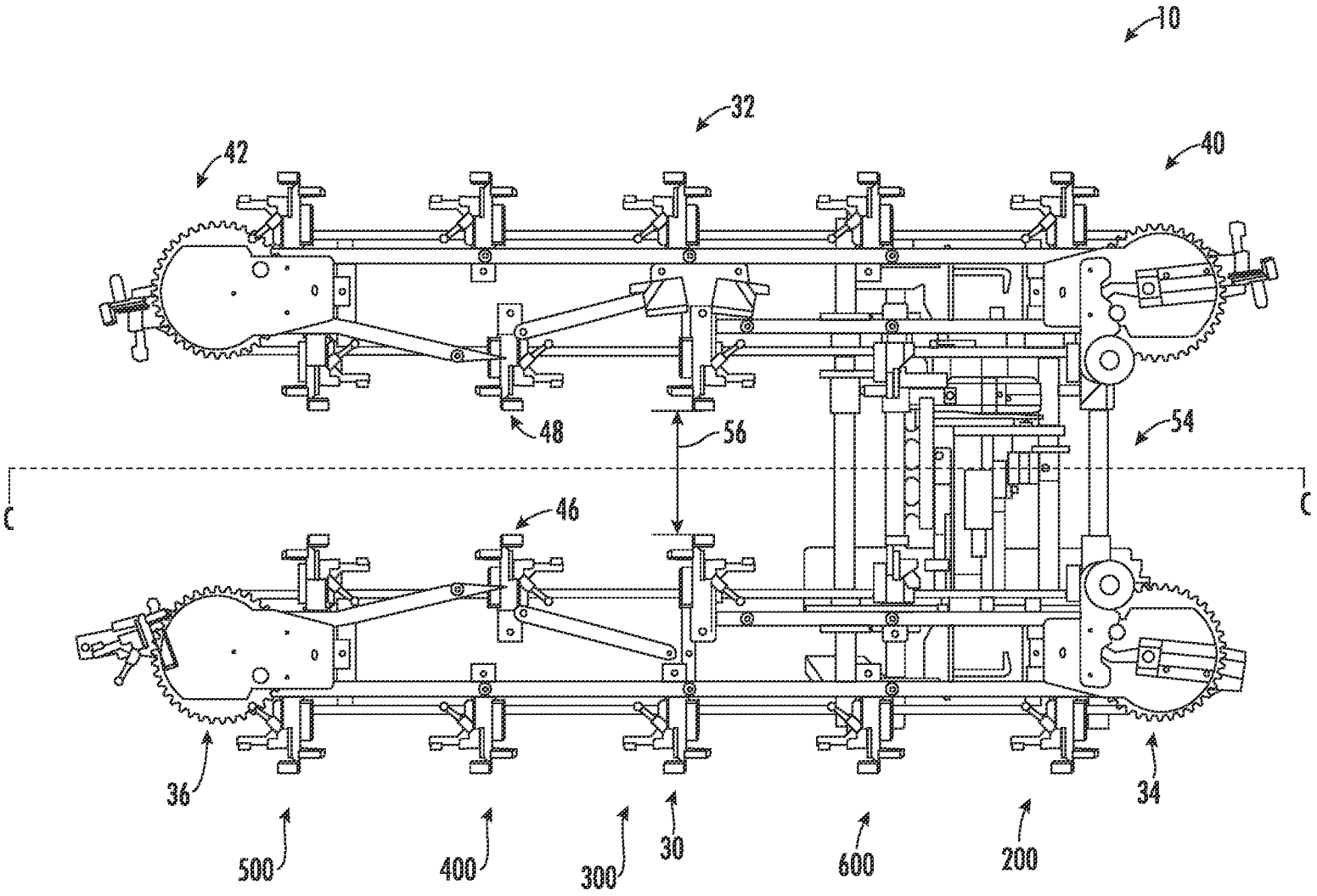
FIG. 13 is a top view of the inline packaging machine of FIG. 12.

In one or more implementations, not all of the depicted components in each figure may be required, and one or more implementations may include additional components not shown in a figure. It should be noted that the features illustrated in the drawings are not necessarily drawn to scale, and features of one embodiment may be employed with other embodiments as the skilled artisan would recognize, even if not explicitly stated herein. Variations in the arrangement and type of the components may be made without departing from the scope of the subject disclosure. Additional components, different components, or fewer components may be used within the scope of the subject disclosure. Moreover, it is noted that like reference numerals represent similar parts throughout the several views of the drawings.

DETAILED DESCRIPTION OF THE DRAWINGS

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

FIGS. 1-14 show an exemplary inline packaging machine 10 constructed in accordance with the present disclosure. The inline machine 10 is designed for filling and sealing containers, such as pouches, of different sizes with rapid, automated changeovers that improve the machine's operating efficiency and reduce down time. The inline machine 10 can automatically adjust for different sized containers, for example through container-related information inputted by an operator into the control assembly of the machine 10 and/or through a sensor assembly 210 (e.g., an optical sensor package including laser sensors). The machine 10 is considered an "inline machine" because its components are substantially linearly aligned and the packaging steps are performed by these aligned components. The machine 10 can accommodate, fill and seal different sized containers while still providing a compact overall footprint where the machine 10 has a width of less than 60 inches and a length of less than 160 inches, and where the machine 10 has a preferable width of 50 inches and a length of 140 inches. This compact overall footprint improves the utility of the machine 10 while providing the customer with significant options as to where to position the machine 10 in the customer's facility, especially as to facilities that are crowded with other machines and packaging equipment.

The inline machine 10 includes a number of stations where various packaging functions are performed on the containers, such as pouches 12. For purposes of explaining the operation of the machine 10, the pouches 12 described below are of the "pre-made" variety and have an openable upper mouth that can be sealed shut after filling, a closed gusseted bottom and sealed side edges extending upward from the bottom to the sealable mouth. Specifically, the machine 10 includes a loading or in-feed station 100 for receiving pouches 12 having different dimensions, including heights, widths and opening widths (see FIGS. 15-18) and a processing system 14 operably connected, preferably mechanically linked, with the loading station 100. The inline machine 10 further includes a control system 16 in mechanical and electrical communication with both the loading station 100 and the processing system 14. The control system 16 is configured to control and monitor all operations of the inline machine 10, in general, and control and monitor both the loading station 100 and the processing system 14, in particular. The control system 16 is programmed to provide for rapid changeovers, which means equal to or less than 30 seconds, preferably less than 20 seconds, and most preferably less than 15 seconds, between various sized and configured pouches that are supplied to the loading station 100. This programming of the control system 16 can include "presets" for commonly sized pouches 12 to make change-over even faster. An operator of the machine 10 can enter pouch-related size information into the control system 16 for different sized pouches, including activating the presets for commonly sized pouches 12. The control system 16 can also be configured to include a sensor assembly 210 that automatically senses the presence of different sized pouches 12 and then makes the necessary adjustments, including to the processing system 14, to allow for the handling and filling of these different pouches 12 by the machine 10. A hood 18 substantially encloses the processing system 14 to protect the processing system 14 during operation of the inline machine 10.

With the hood 18 and other enclosures or paneling 19 removed from the inline machine 10 in FIGS. 4-14, a number of function-specific inline stations of the processing system 14 are shown. In particular, the processing system 14 includes a setup station 200 for receiving the different sized pouches 12 from the loading station 100, an opening station 300 for opening the pouches 12, a filling station 400 for filling the pouches 12 with content, and a sealing and discharging station 500 for sealing the pouches 12 after being filled with content and discharging the pouches 12 after being sealed. The inline machine 10 includes a longitudinal center line C (see FIGS. 3 and 13) which extends along the loading station 100 through the processing system 14 and through to the sealing and discharging station 500. The longitudinal center line C essentially bisects the machine 10 into left and right halves. The stations 100, 200, 300, 400 and 500 of the processing system 14 are substantially aligned on the center line C, wherein the machine 10 has an inline configuration.

With particular reference to FIGS. 1, 2, 4, and 6-9, the loading station 100 includes a plurality of magazine receptacles 102 for receiving the first plurality of pouches 12. Each magazine receptacle 102 is defined by at least one finger 104 extending upward from a conveyer belt 106 of the loading station 100 and by at least one adjustable flange 108 extending upward from the conveyor belt 106 and being longitudinally spaced apart from the fingers 104. The flange 108 can upwardly extend from the belt 106 at an angle to create a sloped support surface for the pouches 12 to be placed in the receptacle 102. The fingers 104 are equally spaced apart from each other along the conveyer belt 106, with the flanges 108 being disposed there between. The distance between the fingers 104 and the flanges 108 can be selectively adjusted to facilitate the precise loading positions for the pouches 12 in each magazine receptacle 102. Each magazine receptacle 102 is configured to receive the first plurality of pouches 12 arranged as a stack of flat, unopened pouches. As such, in contrast to conventional techniques, the first plurality of pouches 12 does not require time consuming "shingling" at the loading station 100 or at any time during operation of the inline machine 10. Moreover, the adjustability of the plurality of magazine receptacles 102 via the adjustable angled flanges 108 allows for varying sized and configured pouches to be loaded at the loading station 100, as will be described in more detail below. Unfilled, flat pouches 12 are loaded into the receptacles 102, namely placed on the angled flanges 108, with the openable end of the pouch 12 in a leading position oriented towards the setup station 200 for receiving and the bottom, closed end of the pouch 12 in a trailing position. Because the flanges 108 are sloped, the stacked pouches 12 are oriented at an angle to the conveyor belt 106 within the receptacle 102. The loading station 100 further includes a transfer mechanism 110 for transferring an individual flat pouch P1 (see FIGS. 4 and 6-9) of the first plurality of pouches 12 from the plurality of magazine receptacles 102 to the setup station 200 of the processing system 14. The transfer mechanism 110 uses suction to engage a portion of the pouch 12 and then transfer it, in a closed state, from the receptacle 102 onto a staging conveyor belt to arrive at a "home" position, that functions as a standardized position, within the setup station 200 for further handling by the processing system 14.

With reference to FIGS. 5, 8, 9-10, and 12-13, the processing system 14 includes a first carrier track assembly 30 and a second carrier track assembly 32 that are arranged about the longitudinal center line C. The first carrier track 30 and the second carrier track 32 are operably configured to provide for inline movement of the pouches 12 through the processing system 14. In particular and referring to FIGS. 8-10 and 12-13, the first carrier track 30 is in mechanical operation with a first drive sprocket 34 disposed proximate the setup station 200 and with a first driven sprocket 36 disposed proximate the sealing and discharging station 500. The first drive sprocket 34 and the first driven sprocket 36 are enmeshed with a first chain (not shown). As such, the first drive sprocket 34, the first driven sprocket 36, and the first chain are collectively configured to drive the first carrier track 30 in a counter-clockwise direction. Similarly, the second carrier track 32 is in mechanical operation with a second drive sprocket 40 disposed proximate the setup station 200 and with a second driven sprocket 42 disposed proximate the sealing and discharging station 500. The second drive sprocket 40 and the second driven sprocket 42 are enmeshed with a second chain (not shown). The second drive sprocket 40, the second driven sprocket 42, and the second chain 44 are collectively configured to drive the second track carrier 32 in a clockwise direction.

A first plurality of clamps 46 is coupled to the first carrier track 30 such that each clamp 46 is disposed equally spaced apart from adjacent clamps 46 along the first carrier track 30. In one embodiment of the machine 10, the first plurality of clamps 46 includes twelve clamps, for example, although it should be understood that any number of clamps 46 are within the scope of this disclosure. Similarly, a second plurality of clamps 48 is coupled to the second carrier track 32 such that each clamp 48 is disposed equally spaced apart from adjacent clamps 48 along the second carrier track 32. The second plurality of clamps 48 includes twelve clamps, for example, although it should be understood that any number of clamps 48 are within the scope of this disclosure. Each clamp 46 of the first plurality of clamps 46 corresponds to a clamp 48 of the second plurality of clamps 48 so that the corresponding clamps 46,48 align with each other across the longitudinal center line C at each of the setup station 200, the opening station 300, the filling station 400, and the sealing and discharging station 500. The first plurality of clamps 46 and the second plurality of clamps 48 are configured to releasably secure a peripheral extent of the pouches 12 such that they hang between corresponding clamps 46, 48. In this way, the corresponding clamps 46, 48 remain aligned as they are advanced, via driven actuation of the first and the second carrier tracks 30, 32, to each of the setup station 200, the opening station 300, the filling station 400, and the sealing and discharging station 500 such that the pouches 12 are received at each of the stations 200-500 for particular processing, as described in more detail below.

The first carrier track 30 and the second carrier track 32 are supported by a first frame 50 and a second frame 52, respectively. An adjusting mechanism 54 (shown in FIGS. 9 and 13) of the processing system 14 mechanically and adjustably couples the first frame 50 to the second frame 52. The adjusting mechanism 54 is configured to adjust a separation distance 56, which is defined as the distance between corresponding clamps 46, 48 of the first plurality of clamps 46 and the second plurality of clamps 48. The adjusting mechanism 54 can include pneumatic cylinders or actuators, or hydraulic cylinders or actuators to adjust the separation distance 56. In the configuration of the machine 10 shown in the Figures, the separation distance 56 extends across the longitudinal center line C. For example, with this commercial embodiment, the adjusting mechanism 54 laterally actuates the first frame 50 and the second frame 52, independently of each other, with respect to the longitudinal center line C, and in turn, the first carrier track 30 and the second carrier track 32, to moveably adjust the separation distance 56 between corresponding clamps 46, 48 of the first plurality of clamps 46 and the second plurality of clamps 48. To accommodate pouches 12 or containers having different dimensions and configurations, the separation distance 56 is adjustable between 3.5 inches to 16 inches. Moreover, the adjusting mechanism 54 is configured to adjust the separation distance 56 relatively quickly within 30 seconds and preferably within 15 seconds.

As shown in FIGS. 3, 7, and 9-11, the opening station 300 includes a vacuum suction cup mechanism 302. The vacuum suction cup mechanism 302 is designed to open the pouches 12 while each is secured between the clamps 46, 48. In particular the vacuum suction cup mechanism 302 includes opposed suction cups 304. The suction cups 304 are opposed from each other across an intersecting line 306 that is orthogonal to the longitudinal center line C. When the pouch 12 is positioned at the opening station 300, the vacuum suction cup mechanism 302 is lowered so that the pouch 12 is arranged between the opposed suction cups 304. The opposed suction cups 304 are then actuated to move towards each other to engage the pouch 12 with a suction force so that the pouch 12 is opened when the opposed suction cups 304 are subsequently actuated to move away from each other. A hexagonal spreader (not shown) can be utilized to further open and/or maintain the pouches 12 in an open state prior to and during the filling of contents. The spreader includes a plurality of fingers or actuators that descend from above to open the pouch 12 in into a hexagonal shape, when viewed from above. For example, the spreader includes four fingers that are inserted into at least the mouth of the pouch 12 and that exert an outwardly directed force to maintain the pouch 12 in an open hexagonal shape for filling, as described below. Due to the outwardly directed force exerted by the fingers, the upper edge of the pouch 12 forms six distinct segments that provide the open hexagonal shape mentioned above.

The filling station 400 includes a funnel 402 terminating at a feeding claw 404. An extent of the feeding claw 404 is designed to be received by the pouch 12 in the opened pouched state for filling the pouch 12 with content, such as a powder, liquid, gel or other similar substance. In particular, with the content loaded into the funnel 402 and the feeding claw 404 inserted into the pouch 12, the feeding claw 404 is actuated to release the content into the pouch 12 in order to sufficiently fill it. The sealing and discharge station 500 includes a sealer 502 designed to seal the pouch 12 after the content is contained in the pouch 12. The sealer 502 includes a hot bar 504 and a brace bar 506. When the pouch 12 is positioned at the sealing and discharge station 500, the sealer 502 is actuated to be lowered downwardly such that the pouch 12, filled with content, is arranged between the hot bar 504 and the brace bar 506. With the pouch 12 arranged in this manner, the hot bar 504 and the brace bar 506 are actuated to compress the top of the pouch P1, thereby sealing it.

Figure 14:
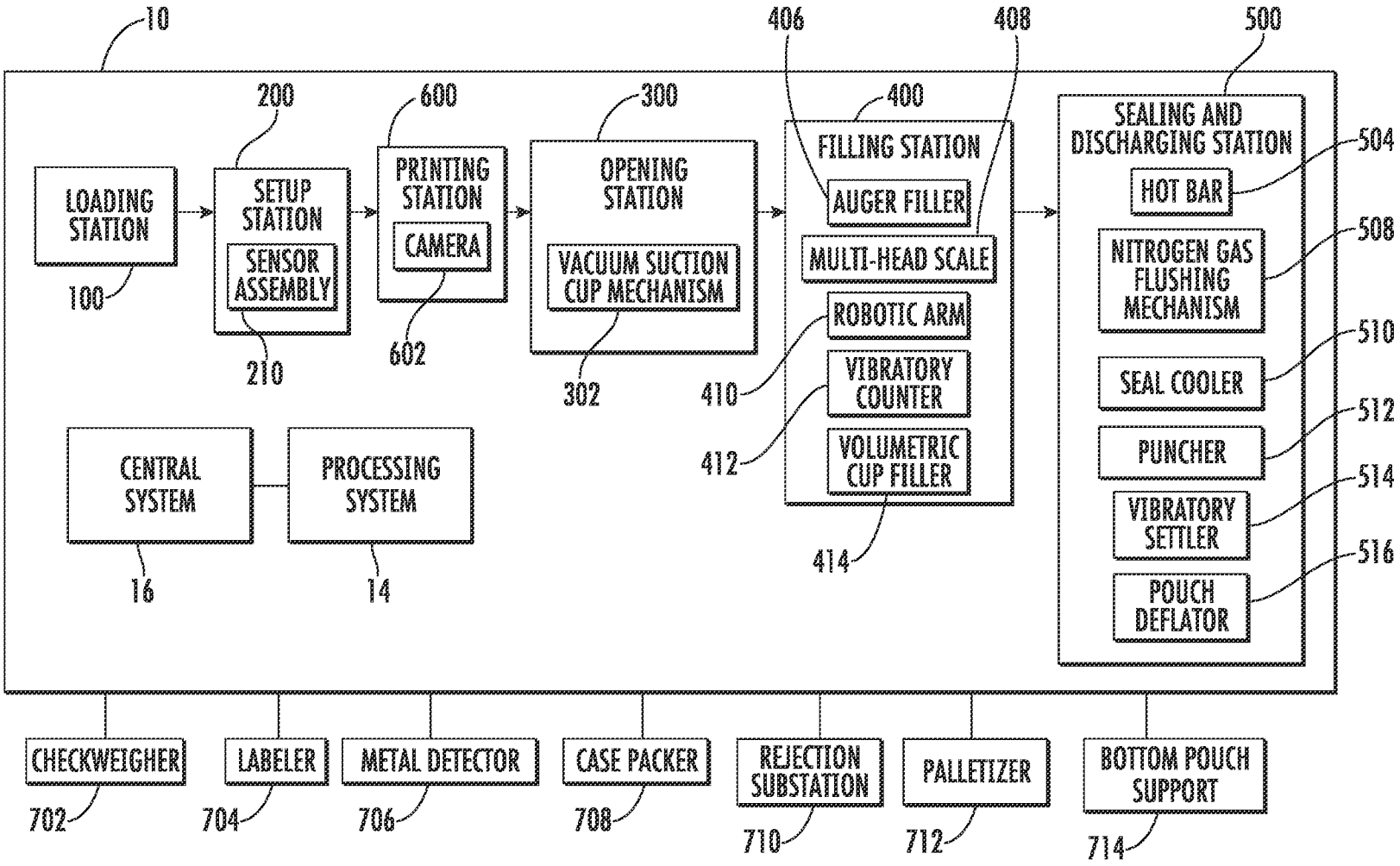
FIG. 14 is a schematic view of the components and functionality of the inline packaging machine.
Figure 15:
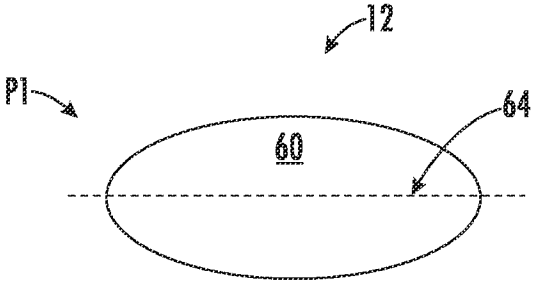
FIG. 15 is a top view of a first pouch shown in an opened pouch state.
Figure 16:
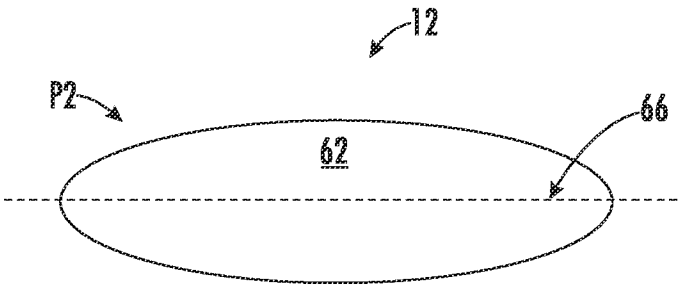
FIG. 16 is a top view of a second pouch shown in an opened pouch state.

FIGS. 14-20 collectively show the inline functionality and operation of the inline machine 10. At the loading station 100, the first plurality of pouches 12 are loaded into a magazine receptacle M1 of the plurality of magazine receptacles 102 and a second plurality of pouches 58 are loaded into an adjacent magazine receptacle M2 of the plurality of magazine receptacles 102. The first plurality of pouches 12 and the second plurality of pouches 58 are single gusset pouches that include an elliptical shaped opening at the top and a gusset at the bottom. Moreover, the first plurality of pouches 12 is smaller in size and configuration than the second plurality of pouches 58. For example, in the opened pouch state, the pouch P1 of the first plurality of pouches 12 includes a first opening area 60 (shown in FIG. 15) that is less than a second opening area 62 (shown in FIG. 16) of a pouch P2 of the second plurality of pouches 58. In particular, the first opening area 60 includes a first opened width OW1 along a first major axis 64 that is less than a second opened width OW2 along a second major axis 66 of the second opening area 62. To further illustrate the size and configuration differential between the pouch P1 and the pouch P2, in the flat closed pouch states, the pouch P1 includes an upper most width W1 at a first upper closed section 68 corresponding to the first opening area 60 of the pouch P1 in the opened pouch state that is less than an upper most width W2 at a second upper closed section 70 corresponding to the second opening area 62 of the pouch P2 in the opened pouch state, as shown in FIGS. 15 and 16, respectively. The upper most widths W1, W2 are in the approximate range of 4 inches to 6 inches. Furthermore, the pouch P1 also includes a height H1 that is less than a height H2 of the pouch P2. The heights H1, H2 are in the approximate range of 6 inches to 21 inches.

Figure 17:
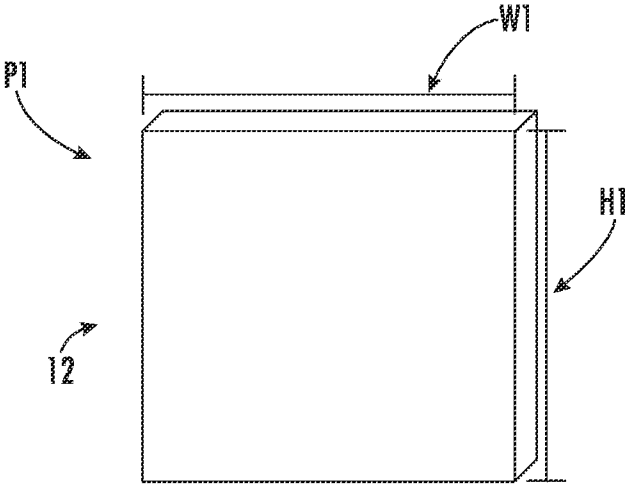
FIG. 17 is a front view of the first pouch of FIG. 15 shown in a flat closed pouch
Figure 18:
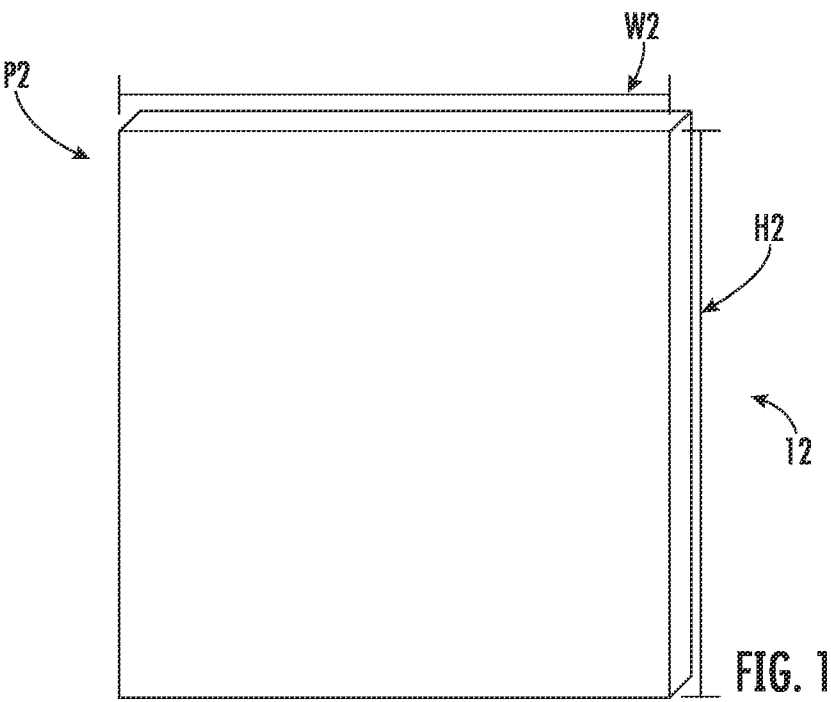
FIG. 18 is a front view of the pouch P2 of FIG. 16 shown in a flat closed pouch state.
Figure 19:
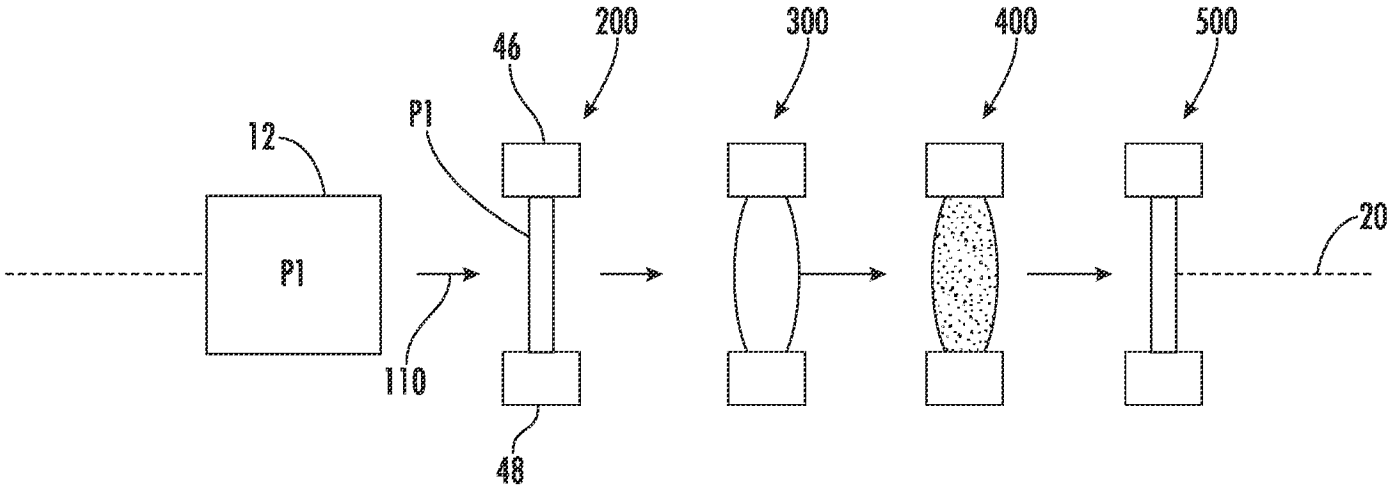
FIG. 19 is a schematic top view of a first pouch advancing inline through the inline packaging machine.

FIG. 17 provides a schematic representation of the first-sized pouches P1 and the second sized pouches P2 moving inline through each station of the inline machine 10. Referring to the left side of FIGS. 7 and 20 a plurality of first-sized pouches P1 are loaded into magazine receptacle M1 and arranged as a stack of flat, unopened pouches P1 at the loading station 100. The transfer mechanism 110 transfers the first-sized pouch P1 inline to a home position in the setup station 200 so that a pair of corresponding clamps of the first plurality of clamps 46 and the second plurality of clamps 48 simultaneously secure a peripheral extent of the pouch P1. In this way, the pouch P1 is aligned along the longitudinal center line C with the long side or width W1 leading in the direction of inline movement through the machine 10. The term "long side leading" is generally recognized in the industry to refer to the upper most width of the pouch P1, being aligned orthogonally to the longitudinal center line C for movement through the inline machine 10. The pouch P1 is then advanced inline from the setup station 200 to the opening station 300 for opening the pouch P1 from the flat closed pouch state to the opened pouch state. The vacuum suction cup mechanism 302 is utilized to open the first-sized pouch P1, wherein a lateral force that is oriented substantially parallel to the longitudinal center line C is applied to pen the pouch P1. The spreader mechanism, through the insertion of its fingers into the mouth of the pouch P1, can also be utilized to maintain the pouch P1 in the open hexagonal shape for filling of contents in the filling station 400.

At the filling station 400, the opened state pouch P1 is filled with contents such as, but not limited to, nuts, chips, granola, powder, trail mix, other food products, medication, and other products. As shown in FIG. 14, the filling station 400 can include an auger filler 406 for filling the pouch P1 with non-free flowing products and products that generate dust such as, but not limited to, coffee, flour, and other similar powders; a multi-head scale 408 for improved weighing accuracy of products such as, but not limited to, cereals and the like, which can allow for more pouches per weight of product and more pouches per shift; a robotic arm 410 for sensitive and fragile products that demand delicate product handling such as, but not limited to, electronics, glass, or other delicate products; a vibratory counter 412 for packaging or filling applications where measuring precision and accuracy are crucial and for products that are uneven such as, but not limited to wafers, grains, nuts, and other uneven products; and/or a volumetric cup filler 414 for free-flowing solids such as, but not limited to, rice, candies, frozen peas, powders that do not generate dust, and other free-flowing products.

After the pouch P1 is filled with product at the filling station 400, the pouch P1 is advanced inline to the sealing and discharging station 500. The sealing and discharging station 500 seals the pouch P1. At the sealing and discharging station 500, the pouch P1 is hot sealed with the sealer 502. Either before or after hot sealing the pouch P1, the sealing and discharging station 500 can optionally perform other functions, as shown in FIG. 14. For example, the sealing and discharging station 500 optionally includes a nitrogen gas flushing mechanism 508 for filling the pouch P1 with nitrogen gas right before sealing to keep the product fresh; a seal cooler 510 for cooling the pouch P1 after it is heat sealed by the sealer 502; a puncher 512, such as, but not limited to, a hole punch, a die cut, and a hot puncher, for punching an aperture through the pouch P1 after it is sealed so the pouch P1 can be hung for display; a vibratory settler 514 for settling the product inside the pouch P1 after sealing; and/or a pouch deflator 516 for eliminating excessive air from the pouch P1 before sealing. After the pouch P1 is fully processed at the sealing and discharging station 500, the pouch P1 is discharged therefrom for further downstream processing. This multi-step inline process continues for the entire quantity of first-sized pouches P1 that are inserted into the loading station 100, such that the entire quantity of first-sized pouches P1 are sequentially advanced from the loading station 100 to the setup station 200 and then advanced through the other stations of the inline machine 10.

As the last pouch of the first-sized pouches P1 are transferred from the loading station 100 to the setup station 200, the plurality of second-sized pouches P2 of the second plurality of pouches 58 are advanced into position on the loading station 100 for transfer to the setup station 200. With the sized pouches P2 in position for transfer to the setup station 200 and after the last of the first-sized pouches P1 discharges from the sealing and discharging station 500, the adjusting mechanism 54 of the processing system 14 independently actuates the first frame 50 and the second frame 52, and thus actuates the first carrier track 30 and the second carrier track 32. This actuation adjusts the distance 56 between the corresponding pair of clamps of the first plurality of clamps 46 and the second plurality of clamps 48 to accommodate the width W2 of the second-sized pouch P2 of the second plurality of pouches 58. In this scenario, the complete adjustment to accommodate the pouch P2 is completed in 30 seconds or less, and preferably within 15 seconds. After the corresponding clamp of the first plurality of clamps 46 and the second plurality of clamp 48 are properly positioned, the transfer mechanism 110 transfers the pouch P2 of the second plurality of pouches 58 inline to the setup station 200 so that the corresponding clamps of the first plurality of clamps 46 and the second plurality of clamps 48 simultaneously releasably secure or clamp the pouch P2. From here, the pouch P2 is advanced through the processing system 14 in a similar manner as described above in regards to the pouch P1, as well as the rest of the pouches of the second plurality of pouches 58.

The inline functionality of the inline machine provides fast throughput and can reach maxim speeds of processing of up to 40 pouches 12, 58 per minute. While the adjusting mechanism 54 is actuated in this scenario because the second plurality of pouches 58 differ in size and configuration from the first plurality of pouches 12, it should be understood that if the second plurality of pouches 58 is the same size and configuration as the first plurality of pouches 12, then no adjustment is required and the pouch P2 can be immediately transferred, without any lag time, from the loading station 100 to the setup station 200 after the last pouch of the first plurality of pouches 12 is advanced from the setup station 200 to the opening station 300.

It should be understood that the inline functionality of the inline machine 10 provides a compact footprint that takes up less space on the work floor compared to conventional packaging machines. In addition, the inline machine 10 is also contrasted from conventional packaging machines in that the changeover time between different pouch sizes is greatly reduced, which increases the efficiency and effectiveness of machine throughput.

Figure 20:
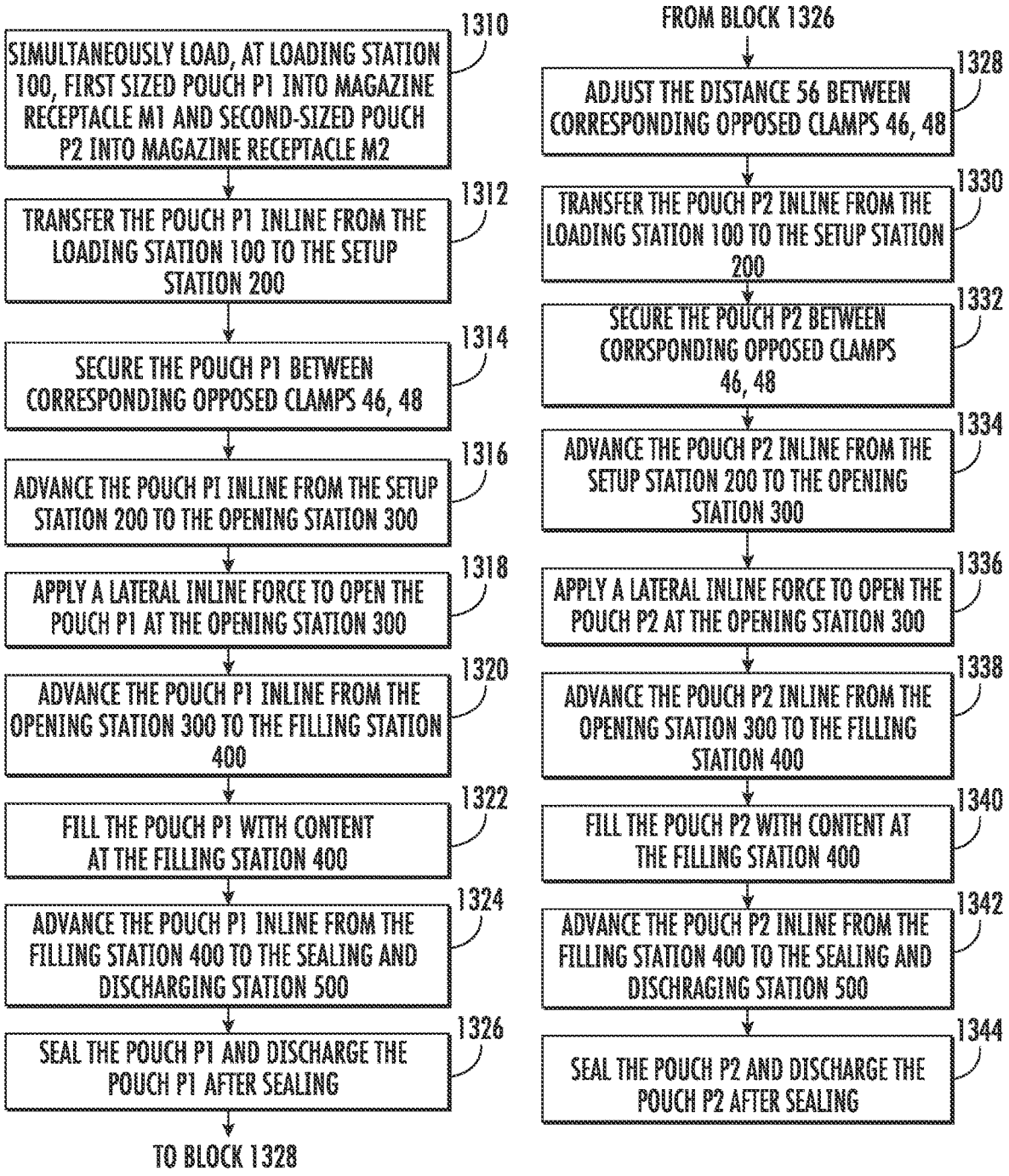
FIG. 20 is a flow chart illustrating an exemplary packaging operation of the inline packaging machine for two different sized pouches.

FIG. 20 illustrates a flowchart 1300 showing a sequence of steps which may be performed to operate the inline machine 10 for filling and sealing pouches of varying sizes and configurations with rapid, automated changeovers that improves the machine's operating efficiency. Block 1310 depicts the step of loading, at the loading station 100, the pouches P1 and the pouches P2 into magazine receptacles M1 and M2, respectively, which are a collection of magazine receptacles 102. Pouches P1 have a different size and configuration than the size and configuration of pouches P2. Pouches P1, P2 are simply stacked, openable end leading and on angle due to the sloped support surface of flanges 108, in the receptacles 102. The pouches P1, P2 are not shingled in the receptacles 102. Accordingly, magazine receptacle M1 includes a large number of stacked pouches P1 in receptacles 102, and magazine receptacle M2 includes a large number of stacked pouches P2 in receptacles 102.

Block 1312 depicts the step of using the transfer mechanism 110 to transfer the pouch P1 inline from the loading station 100 onto a conveyor to arrive at a home position within the setup station 200, where the openable end of the pouch P1 is leading and the closed, lower end of the pouch P1 is trailing. At the setup station 200, an engaging arm grasps the pouch P1 and pivots it such that the openable end of the pouch P1 is upwardly oriented. The pouch P1 is secured between one of the first plurality of clamps 46 and one of the second plurality of clamps 48, as depicted in block 1314. In other words, the first and second clamps 46, 48 engage and secure the pouch P1, preferably at opposite upper ends of the openable portion of the pouch P1. Block 1316 depicts the inline advancing of the pouch P1 from the setup station 200 to the opening station 300. The opening of the pouch P1 at the opening station 300 is depicted in block 1318. The spreader mechanism, as detailed above, can be utilized to maintain the pouch P1 in the open position. With the pouch P1 opened, the pouch P1 is advanced inline to filling station 400, as depicted in block 1320. Filling the pouch P1 with content(s) at the filling station 400 is depicted in block 1322. Block 1324 depicts the inline advancing of the pouch P1 from the filling station 400 to the sealing and discharging station 500. As depicted in block 1326, at the sealing and discharging station 500, the hot bar 502 seals the pouch P1 whereupon the pouch P1 is then discharged after sealing.

As mentioned above, magazine receptacle M1 includes a large number of stacked pouches P1 in receptacles 102, and magazine receptacle M2 includes a large number of stacked pouches P2 in receptacles 102. When the inline processing of the first-sized pouches P1 is completed, the transfer mechanism 110 transfers the second-sized pouches P2 from the loading station 100 onto the conveyor to arrive at a home position (which can be different than the home position for the different sized pouch P1) within the setup station 200, where the openable end of the pouch P2 is leading. The control system 16 is constantly monitoring operation of the machine 10, and when it detects the larger pouches P2 with the sensor assembly, the control system 16 initiates a preset program(s) that automatically adjusts the separation distance 56 between corresponding clamps 46, 48 of the first plurality of clamps 46 and the second plurality of clamps 48 to accommodate the width W2 of the pouch P2, as depicted in block 1328. Alternatively, an operator of the machine 10 manually activates the preset program(s) loaded into the control system 16 to allow for adjustment between the separation distance 56 and enable inline processing of the second-sized pouches P2. In some embodiments, adjusting the separation distance 56 involves the adjusting mechanism 54 independently actuating the first frame 50 supporting the first carrier track 30 and the second frame 52 supporting the second carrier track 32, whereby the separation distance 56 between the first and second frames 50, 52 is altered. In other embodiments, adjusting the separation distance 56 involves the adjusting mechanism 54 only actuating the first frame 50 supporting the first carrier track 30. In yet other embodiments, adjusting the separation distance 56 involves the adjusting mechanism 54 only actuating the second frame 52 supporting the second carrier track 32.

After the separation distance 56 is properly adjusted to accommodate the width W2 of the second-sized pouches P2, the inline transferring of second-sized pouches P2 from the loading station 100 to the setup station 200 is depicted in block 1330. As mentioned above, the control system 16 is utilized to adjust the separation distance 56 and permit handling of the different-sized pouch P2. This adjustment process is referred to as a "changeover" and the inventive machine 10, including the control system 16, rapidly accomplishes the changeover in 30 seconds or less, preferably less than 20 seconds, most preferably less than 15 seconds. The rapid changeover minimizes the downtime of the machine 10 while maintaining its operating efficiency as compared to conventional packaging machines that suffer from lengthy downtime and reduced operating efficiency as a result of time consuming changeovers. At the setup station 200, the engaging arm grasps the second-sized pouch P2 and pivots it such that the openable end of the pouch P2 is upwardly oriented and then places the second-sized pouch P2 between corresponding clamps 46, 48 of the first plurality of clamps 46 and the second plurality of clamps 48 for securement there between, as depicted in block 1332. Block 1334 depicts the inline advancing of the pouch P2 from the setup station 200 to the opening station 300. The opening of the pouch P2 at the opening station 300 is depicted in block 1336. With the pouch P2 opened, the pouch P2 is advanced inline to filling station 400, as depicted in block 1338. Filling the pouch P2 with content at the filling station 400 is depicted in block 1340. Block 1342 depicts the inline advancing of the pouch P2 from the filling station 400 to the sealing and discharging station 500. As depicted in block 1344, at the sealing and discharging station 500, the hot bar 502 seals the pouch P2 and the pouch P2 is then discharged after sealing.

In the event first-sized pouches P1 are loaded into the magazine receptacle M1 while second-sized pouches P2 are being handled and filled, the machine 10 processes and handles first-sized pouches P1 in the manner discussed in the foregoing paragraphs. If third-sized pouches P3 (not shown), having different dimensions than the first and second pouches P1, P2 are loaded into the loading station 100, then the control system 16 alone, or with input provided by an operator, detects the differing third pouches and automatically adjusts the separation distance 56 between corresponding clamps 46, 48 to allow for inline processing of the third pouches consistent with the foregoing paragraphs.

In a first alternative embodiment, the structure and operation of the inline machine 10 is substantially the same as the commercial embodiment described above except that the adjusting mechanism 54 of the processing system 14 is configured to operate in a slightly different manner. For instance, the first frame 50 supporting the first carrier track 30 is fixed in position so that the adjusting mechanism 54 is configured to laterally actuate the second frame 52 supporting the second carrier track 32 with respect to the longitudinal center line C to moveably adjust the separation distance 56 between corresponding clamps of the first plurality of clamps 46 and the second plurality of clamps 48. In a similar embodiment, the second frame 52 supporting the second carrier track 32 is fixed in position, instead, so that the adjusting mechanism 54 is configured to laterally actuate the first frame 50 supporting the first carrier track 30 with respect to the longitudinal center line C to movably adjust the separation distance 56 between corresponding clamps of the first plurality of clamps 46 and the second plurality of clamps 48.

In any of the previously described embodiments, the processing system 14 of the inline machine 10 optionally or additionally includes a printing station 600 (see FIG. 14) for printing codes and/or dates on the pouches. In such embodiments, the printing station 600 is disposed inline between the setup station 200 and the opening station 300. In addition, the printing station 600 optionally includes a camera 602 for verifying correct printing of the codes and/or dates.

Additionally, with any of the previously described embodiments, as shown in FIG. 14, the inline machine 10 is configured to optionally include various inline upstream or downstream sub-stations including, but not limited to, a checkweigher 702 for improving weight control and verification; a labeler 704 for automatically applying labels to the pouches of the first plurality of pouches 12 and the second plurality of pouches 58; a metal detector 706 for detecting unwanted metal particles inadvertently contained in the pouches; a case packer 708 for packing pouches in a variety of cases and/or boxes; a rejection substation 710 for automatically discovering and removing scrap pouches; and a palletizer 712, which is either robotic or traditional, for stacking ready-to-ship pallets.

Furthermore, in any of the previously described embodiments, the inline machine 10 also optionally includes a bottom pouch support 714 for providing additional support for pouches with heavier product. The bottom pouch support 714 is a conveyer system disposed between the first frame 50 and the second frame 52 below the first carrier track 30 and the second carrier track 32. The enclosures or panels 19 of the inline machine 10 are optionally NEMA 4x enclosures or panels for providing efficient and safe cleaning without concern of rust or damaging electrical components.

While the present disclosure has been described in terms of exemplary embodiments, those skilled in the art will recognize that the present disclosure can be practiced with modifications in the spirit and scope of the appended claims. Further, a person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," etc. as may be used herein are intended for illustrative purposes only and do not limit the embodiments in any way. The term "plurality" as used herein indicates any number greater than one, either disjunctively or conjunctively, as necessary, up to an infinite number. The word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications, and variations that fall within the true scope of the present teachings.

What is claimed is:

1. An inline machine for filling and sealing pouches of varying sizes and configurations, the inline machine comprising:

a center line; and a first carrier track opposing a second carrier track with respect to the center line, the first carrier track and the second carrier track being laterally adjustable with respect to the center line to accommodate securing a first pouch and a second pouch; and a filling station for filling the first pouch and the second pouch;

wherein the first pouch includes a first upper most width in a flat closed pouch state and the second pouch includes a second upper most width in the flat closed pouch state that is different from the first upper most width, and wherein the first carrier track and the second carrier track are laterally adjustable to position the first pouch and the second pouch in a location for filling at the filling station.

2. The inline machine of claim 1, further including a loading station for receiving the first pouch and the second pouch in the flat closed pouch state, wherein the loading station is disposed longitudinally along the center line and upstream of the first carrier track and the second carrier track.

3. The inline machine of claim 2, wherein the first pouch is received in a first magazine receptacle of the loading station and the second pouch is received in a second magazine receptacle of the loading station.

4. The inline machine of claim 1, further including at least one first clamp disposed on the first carrier track and at least one second clamp disposed on the second carrier track, wherein the at least one first clamp and the at least one second clamp are laterally adjustable to releasably and securely receive the first pouch and the second pouch at a setup station of the inline machine.

5. The inline machine of claim 4, wherein the first carrier track and the second carrier track are configured to advance the first pouch and the second pouch from the setup station inline to an opening station of the inline machine.

6. The inline machine of claim 5, wherein the first carrier track and the second carrier track are configured to advance the first pouch and the second pouch from the opening station inline to a filling station of the inline machine.

7. The inline machine of claim 6, wherein the first carrier track and the second carrier track are configured to advance the first pouch and the second pouch from the filling station to a sealing and discharging station of the inline machine.

8. The inline machine of claim 1, further comprising:

a control in electrical communication with a first carrier track assembly of the first carrier track and a second carrier track assembly of the second carrier track, wherein the control is configured to automatically adjust the first carrier track and the second carrier track after receiving an indication for processing the second pouch in place of the first pouch.

9. The inline machine of claim 8, further comprising:

a sensor in communication with the control, wherein the indication of the second pouch is received when the sensor senses the second pouch.

10. The inline machine of claim 8, wherein the indication for processing the second pouch is received from an operator.

11. An inline machine for filling and sealing pouches of varying sizes and configurations, the inline machine comprising:

a loading station having a conveyor and a first magazine and a second magazine operatively coupled to the conveyor, and wherein the first magazine comprises at least a first pouch and the second magazine comprises at least a second pouch;

a center line; and a first carrier track opposing a second carrier track with respect to the center line, wherein one of the first carrier track and the second carrier track is laterally adjustable with respect to the center line to accommodate securing the first pouch and the second pouch, wherein the first pouch includes a first upper most width in a flat closed pouch state and the second pouch includes a second upper most width in the flat closed pouch state that is different from the first upper most width, and wherein the conveyor advances the first magazine out of position and the second magazine into position when the second pouch of the second magazine is to be filled.

12. The inline machine of claim 11, wherein the loading station is configured for receiving the first pouch and the second pouch in the flat closed pouch state, and wherein the loading station is disposed longitudinally along the center line and upstream of the first carrier track and the second carrier track.

13. The inline machine of claim 12, wherein the conveyor comprises a plurality of fingers or a plurality of flanges, wherein at least one finger of the plurality of fingers or at least one flange of the plurality of flanges are adjustable to define the first magazine and the second magazine of the conveyor of the loading station.

14. The inline machine of claim 11, further including at least one first clamp disposed on the first carrier track and at least one second clamp disposed on the second carrier track, wherein the at least one first clamp and the at least one second clamp are laterally adjustable to releasably and securely receive the first pouch and the second pouch at a setup station of the inline machine.

15. The inline machine of claim 14, wherein the first carrier track and the second carrier track are configured to advance the first pouch and the second pouch from the setup station inline to an opening station of the inline machine.

16. The inline machine of claim 15, where the first carrier track and the second carrier track are configured to advance the first pouch and the second pouch from the opening station inline to a filling station of the inline machine.

17. The inline machine of claim 16, wherein the first carrier track and the second carrier track are configured to advance the first pouch and the second pouch from the filling station to a sealing and discharging station of the inline machine.

18. The inline machine of claim 11, further comprising:

a control in electrical communication with a first carrier track assembly of the first carrier track and a second carrier track assembly of the second carrier track, wherein the control is configured to automatically adjust the first carrier track or the second carrier track after receiving an indication for processing the second pouch in place of the first pouch.

19. An inline machine for filling and sealing pouches of varying sizes and configurations, the inline machine comprising:

a center line;

a first carrier track assembly having a first carrier track and a second carrier track assembly having a second carrier track, wherein the first carrier track is opposing the second carrier track with respect to the center line, wherein one of the first carrier track and the second carrier track is laterally adjustable with respect to the center line to accommodate securing a first pouch and a second pouch, wherein the first pouch includes a first upper most width in a flat closed pouch state and the second pouch includes a second upper most width in the flat closed pouch state that is different from the first upper most width; and a control in electrical communication with the first carrier track assembly or the second carrier track assembly, wherein the control is configured to automatically adjust the first carrier track or the second carrier track after receiving an indication for processing the second pouch in place of the first pouch.

20. The inline machine of claim 19, further comprising:

a sensor in communication with the control, wherein the indication of the second pouch is received when the sensor senses the second pouch.

21. The inline machine of claim 19, wherein the indication for processing the second pouch is received from an operator.

22. The inline machine of claim 19, further comprising a loading station for receiving the first pouch and the second pouch in the flat closed pouch state, wherein the loading station is disposed longitudinally along the center line and upstream of the first carrier track and the second carrier track.

23. The inline machine of claim 19, further including at least one first clamp disposed on the first carrier track and at least one second clamp disposed on the second carrier track, wherein the at least one first clamp and the at least one second clamp are laterally adjustable to releasably and securely receive the first pouch and the second pouch at a setup station of the inline machine.

24. The inline machine of claim 23, wherein the first carrier track and the second carrier track are configured to advance the first pouch and the second pouch from a setup station inline to an opening station of the inline machine; from the opening station inline to a filling station of the inline machine; and from the filling station to a sealing and discharging station of the inline machine.

* * * * *